US010562312B2

(12) United States Patent
Kimura et al.

(10) Patent No.: US 10,562,312 B2
(45) Date of Patent: Feb. 18, 2020

(54) LIQUID EJECTING APPARATUS

(71) Applicant: SEIKO EPSON CORPORATION, Tokyo (JP)

(72) Inventors: Naomi Kimura, Okaya (JP); Shoma Kudo, Shiojiri (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/153,512

(22) Filed: Oct. 5, 2018

(65) Prior Publication Data

US 2019/0105903 A1 Apr. 11, 2019

(30) Foreign Application Priority Data

Oct. 6, 2017 (JP) ..... 2017-195823
Oct. 10, 2017 (JP) ..... 2017-196624
Mar. 20, 2018 (JP) ..... 2018-052174

(51) Int. Cl.

| | |
|---|---|
| ***B41J 2/175*** | (2006.01) |
| ***B41J 2/17*** | (2006.01) |
| ***B41J 2/165*** | (2006.01) |
| ***B41J 29/02*** | (2006.01) |
| ***B41J 29/13*** | (2006.01) |

(52) U.S. Cl.

CPC ..... *B41J 2/17506* (2013.01); *B41J 2/16508* (2013.01); *B41J 2/16517* (2013.01); *B41J 2/16538* (2013.01); *B41J 2/1721* (2013.01); *B41J 2/1752* (2013.01); *B41J 2/17509* (2013.01); *B41J 29/02* (2013.01); *B41J 29/13* (2013.01)

(58) Field of Classification Search

CPC .... B41J 2/17506; B41J 2/1752; B41J 2/1721; B41J 2/16538; B41J 2/16517; B41J 29/02; B41J 29/13

See application file for complete search history.

(56) References Cited

U.S. PATENT DOCUMENTS

| | | | | |
|---|---|---|---|---|
| 5,675,367 | A * | 10/1997 | Scheffelin | B41J 2/17506 347/86 |
| 6,338,539 | B1 * | 1/2002 | Kobayashi | B41J 2/16532 347/108 |
| 7,090,341 | B1 | 8/2006 | Miyazawa | |
| 2006/0098062 | A1 | 5/2006 | Miyazawa | |
| 2006/0284946 | A1 | 12/2006 | Miyazawa | |

(Continued)

FOREIGN PATENT DOCUMENTS

| | | |
|---|---|---|
| JP | 2005-16137 A | 6/2005 |
| JP | 2008-247043 A | 10/2008 |
| JP | 2015-199264 A | 11/2015 |

*Primary Examiner* — Geoffrey S Mruk

(74) *Attorney, Agent, or Firm* — Workman Nydegger

(57) ABSTRACT

A liquid ejecting apparatus includes a liquid ejecting head which ejects a liquid from a nozzle onto a medium, a liquid storage member which stores the liquid to be supplied to the liquid ejecting head, and a carriage on which the liquid ejecting head and the liquid storage member are installed and which is capable of moving on a movement path. The liquid storage member includes a liquid filling port which is disposed above the liquid ejecting head and is for filling the liquid. The liquid filling port is provided at a position which does not overlap with a nozzle forming surface in which the nozzle is formed in plan view from above.

13 Claims, 18 Drawing Sheets

(56) References Cited

U.S. PATENT DOCUMENTS

| | | | |
|---|---|---|---|
| 2008/0151021 | A1 | 6/2008 | Miyazawa |
| 2008/0303883 | A1 | 12/2008 | Miyazawa |
| 2015/0283832 | A1 | 10/2015 | Osakabe |

* cited by examiner

LIQUID EJECTING APPARATUS

BACKGROUND

1. Technical Field

The present invention relates to a liquid ejecting apparatus.

2. Related Art

In the related art, a so-called off-carriage type liquid ejecting apparatus, in which an ink tank capable of continuously supplying an ink is provided outside of the carriage, is used as a liquid ejecting apparatus of a printer (for example, refer to JP-A-2015-199264). In this configuration, since the ink tank is generally provided at a position lower than a head, the head is not dirtied even if the ink dribbles during ink filling from an ink filling port.

In contrast, in a so-called on-carriage type liquid ejecting apparatus in which an ink tank capable of continuously supplying an ink is installed on the carriage, a configuration is conceivable in which the ink filling port is disposed above a liquid ejecting head and a maintenance system due to the structure in which the ink tank is installed on the carriage.

However, in a case in which a configuration is adopted in which the ink filling port is disposed above the liquid ejecting head and the maintenance system in the on-carriage type liquid ejecting apparatus, when an ink dribbles during ink filling, there is a possibility of the ink adhering to each element such as the liquid ejecting head and the maintenance system under the ink filling port, which may lead to printing problems and the like and a reduction in the reliability of each element.

SUMMARY

An advantage of some aspects of the invention is to provide a liquid ejecting apparatus in a so-called on-carriage type recording apparatus in which an ink tank is installed on a carriage where the liquid ejecting apparatus is capable of suppressing a reduction in reliability of each element such as a liquid ejecting head and a maintenance system in a case in which, during ink filling, the ink dribbles into an inner portion of the carriage.

According to an aspect of the invention, there is provided a liquid ejecting apparatus including a liquid ejecting head which ejects a liquid from a nozzle onto a medium, a liquid storage member which stores the liquid to be supplied to the liquid ejecting head, and a carriage on which the liquid ejecting head and the liquid storage member are installed and which is capable of moving on a movement path, in which the liquid storage member includes a liquid filling port which is disposed above the liquid ejecting head and is for filling the liquid, and in which the liquid filling port is provided at a position which does not overlap with a nozzle forming surface in which the nozzle is formed in plan view from above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
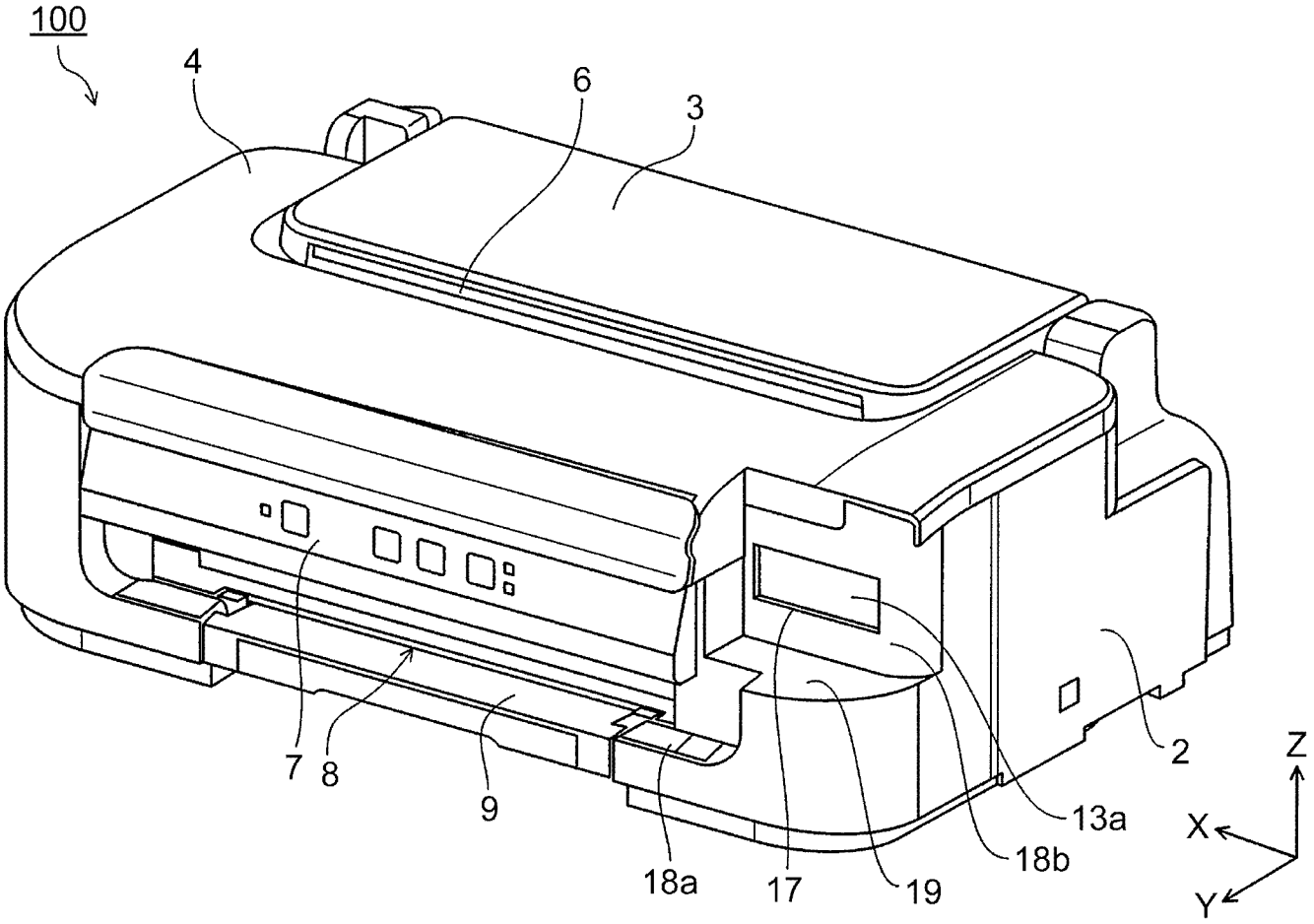
FIG. 1 is a perspective view illustrating a printer (a recording apparatus) which is an example of an application target of the invention.

Favorable embodiments of the invention will be described with reference to the attached drawings. The same reference numerals will be given to the same or similar constituent elements in the respective drawings.

Schematic Configuration of Recording Apparatus

First, a description will be given of a schematic configuration example of the recording apparatus which serves as an application target of the invention. Hereinafter, a description will be given of an ink jet printer (hereinafter referred to simply as a printer) as an example of the recording apparatus (refer to FIGS. 1 to 5).

In the X-Y-Z coordinate system illustrated in each of the drawings, an X direction is a movement direction of a liquid ejecting head 10 (that is, the movement direction of a carriage 30) and is a width direction of a printer 100. A Y direction indicates a depth direction of the printer 100 and a Z direction indicates a height direction of the printer 100. In each of the drawings, a +Y direction is a front side or a frontal side of the printer 100 and a −Y direction is a rear side or a rearward side of the printer 100. As viewed from the front side of the printer 100, the left side is a +X direction and the right side is a −X direction. A +Z direction is above (including the top portion, the top surface, and the like) the printer 100, and a −Z direction is below (including the bottom portion, the bottom surface, and the like) the printer 100.

Figure 2:
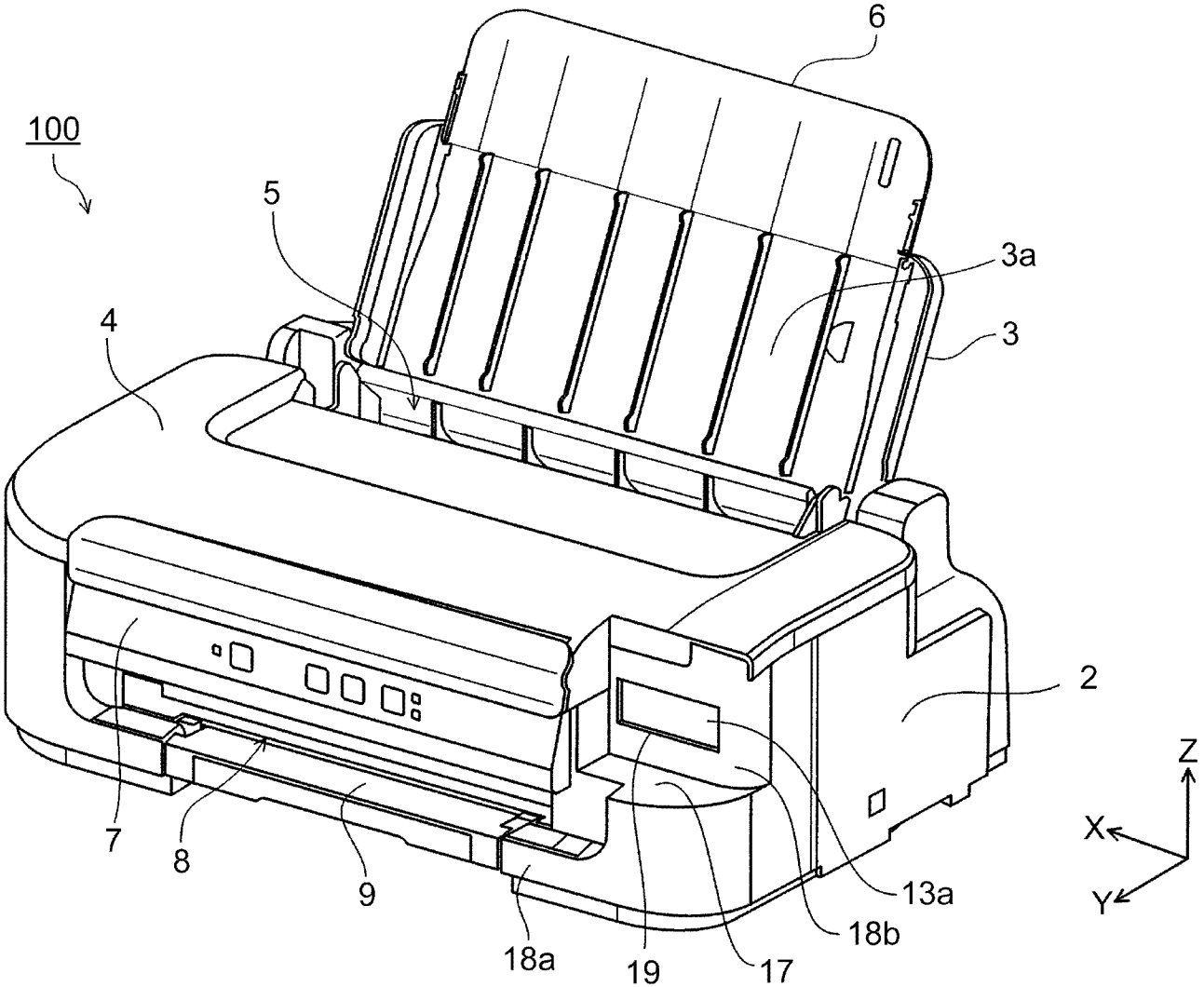
FIG. 2 is a perspective view illustrating the printer in a state in which a paper support is opened from a state illustrated in FIG. 1.

The external appearance of the printer 100 is configured by the liquid ejecting head 10, a housing 2, a paper support 3, and a top portion cover 4. The liquid ejecting head 10 ejects a liquid (hereinafter, simply referred to as an ink) such as an ink from nozzles 11, an inner portion of the housing 2 includes the liquid ejecting head 10, the paper support 3 includes a rotational movement shaft on the rear side of the housing 2 and opens and closes, and the top portion cover 4 opens and closes the top portion of the housing 2. When the paper support 3 is opened, a setting port 5 which is provided on the top portion of the housing 2 is revealed. A medium, for example, printing paper is inserted into the setting port 5. The paper support 3 is a cover which opens and closes a region including the setting port 5 on the top portion of the housing 2, and, as illustrated in FIG. 2, is configured to assume an inclined posture in the open state and supports the paper which is set on the setting port 5 on a support surface 3*a*.

The paper support 3 is provided with an auxiliary paper support 6 which may be stored in an inner portion of the paper support 3 and is configured such that the auxiliary paper support 6 may be pulled out from the inner portion of the paper support 3. It becomes possible to stably support a longer sheet of paper by pulling out the auxiliary paper support 6 (refer to FIG. 2).

The paper which is set in the setting port 5 is fed in the +Y direction by a medium transport apparatus (not illustrated). Recording is performed by the liquid ejecting head 10 in the inner portion of the housing 2 and the paper is discharged from a discharge portion 8 which is provided on the front surface of the housing 2 after the recording.

Figure 3:
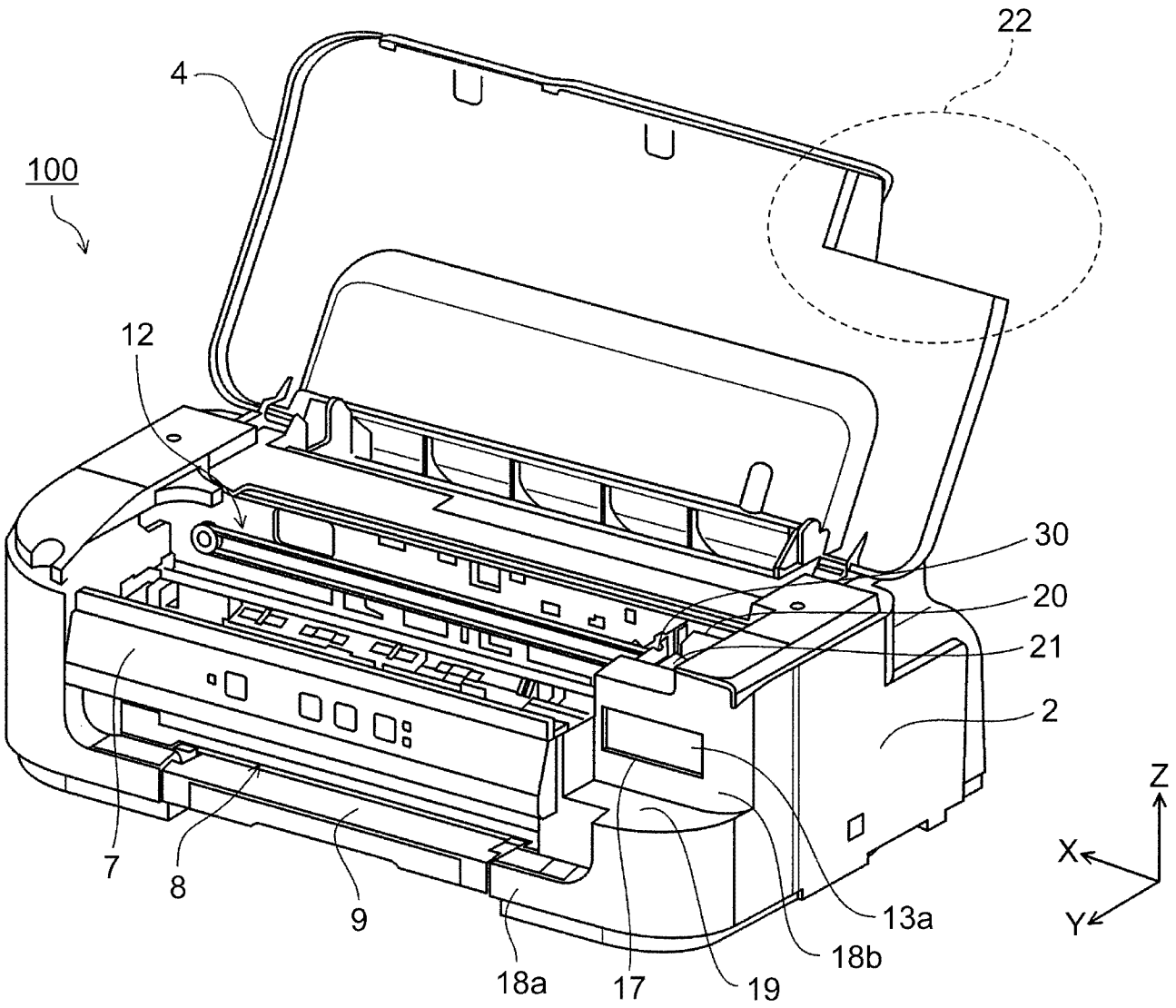
FIG. 3 is a perspective view illustrating the printer in a state in which a top portion cover is opened from a state illustrated in FIG. 2.

When the top portion cover 4 is opened, the inner portion of the housing 2 is exposed (refer to FIG. 3). The carriage 30 which includes the liquid ejecting head 10 which discharges the ink onto the paper to perform recording is provided in the inner portion of the housing 2. In the carriage 30, the liquid ejecting head 10 is provided on the base portion, that is, the −Z direction side and is not visible in FIG. 3. The carriage 30 is configured to be capable of being moved in the width direction (the X direction) which intersects a medium transport direction (the +Y direction) on a movement path T30 of the carriage 30 by a transport portion including a belt movement mechanism (indicated by reference numeral 12 in FIG. 3) and the like. When the top portion cover 4 is opened, it is preferable for at least a portion of a liquid filling port 32 of the carriage 30 and a cap member 33 to become visible.

An ink tank 20 (a liquid storage member) which stores the ink (the liquid) to be supplied to the liquid ejecting head 10 is provided on the carriage 30. In the present embodiment, the ink tank 20 is for one color (black). However, it is possible to install a plurality of ink tanks corresponding to a plurality of colors on the carriage 30.

Figure 4:
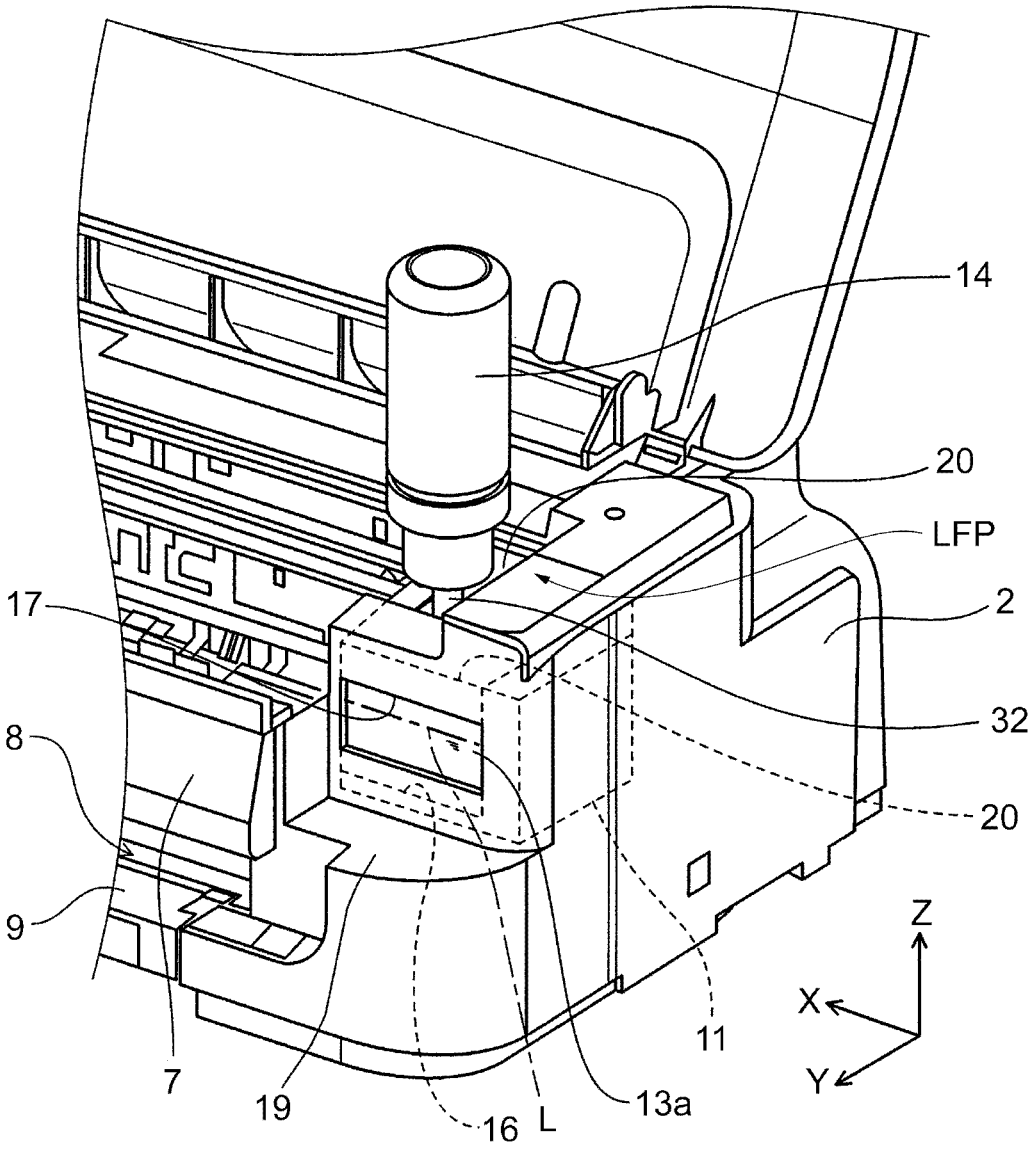
FIG. 4 is a perspective view illustrating a portion of the printer in a state in which a refilling container is attached to a filling port of an ink tank.

In the present embodiment, the ink tank 20 is provided with the liquid filling port 32 from which it is possible to fill the ink tank 20 with the ink from a refilling container 14 (refer to FIG. 4). The liquid filling port 32 is disposed above the liquid ejecting head 10 and is ordinarily closed by a cap 21 (refer to FIGS. 3 and 5). It is possible to perform the refilling of the ink tank 20 with the ink in a state in which the cap 21 is removed and the carriage 30 is positioned at a liquid-fillable position LFP by mounting the refilling container 14 on the liquid filling port 32 (refer to FIG. 4).

In the present embodiment, an operation panel 7 which receives operational input in the printer 100 is provided on the front surface of the housing 2 (refer to FIG. 1 and the like). The operation panel 7 is provided above the discharge portion 8. An output tray 9 which is configured to be possible to pull out is provided in the discharge portion 8.

Although a detailed description will be omitted, the printer 100 of the present embodiment further includes a level checking portion 13*a* of the ink tank 20, a first viewing portion 16, and a second viewing portion 17 (refer to FIG. 1 and the like). The level checking portion 13*a* is formed by a material which has transparency and through which it is possible to visually recognize the remaining amount of liquid of the inner portion of the ink tank 20, the first viewing portion 16 enables the visual recognition of the level checking portion 13*a* of the ink tank 20, and the second viewing portion 17 enables the visual recognition of the level checking portion 13*a* via the first viewing portion 16. It is possible to visually recognize a liquid surface L of the ink inside the ink tank 20 in the level checking portion 13*a* (refer to FIG. 5).

In FIG. 2, a reference numeral 18*a* indicates a surface on the front side of the apparatus on which the operation panel 7 and the like are provided, a reference numeral 18*b* indicates a surface at a deeper position than the surface 18*a* on which the second viewing portion 17 is disposed, and a reference numeral 19 indicates a recessed portion in which the second viewing portion 17 is positioned toward the rear, offset from the surface 18*a*. A reference numeral 22 indicates a cutout portion which is configured such that the recessed portion 19 is not hidden by the top portion cover 4 in the closed state (refer to FIG. 3 and the like).

Next, a description will be given of favorable embodiments of the invention. Hereinafter, a description will be given of a liquid ejecting apparatus 1 of the printer 100 to which the invention is applied, with reference to the drawings (refer to FIGS. 6 to 10).

Configuration of Liquid Ejecting Apparatus

First Embodiment

The liquid ejecting apparatus 1 in the printer 100 of the present embodiment is provided with the liquid ejecting head 10, the ink tank 20, the carriage 30, and the like. The carriage 30 is provided with the liquid filling port 32 and the cap member 33. The printer 100 may further include a regulating portion 23, a cap 60, a wiping member 80, and the like.

Figure 5:
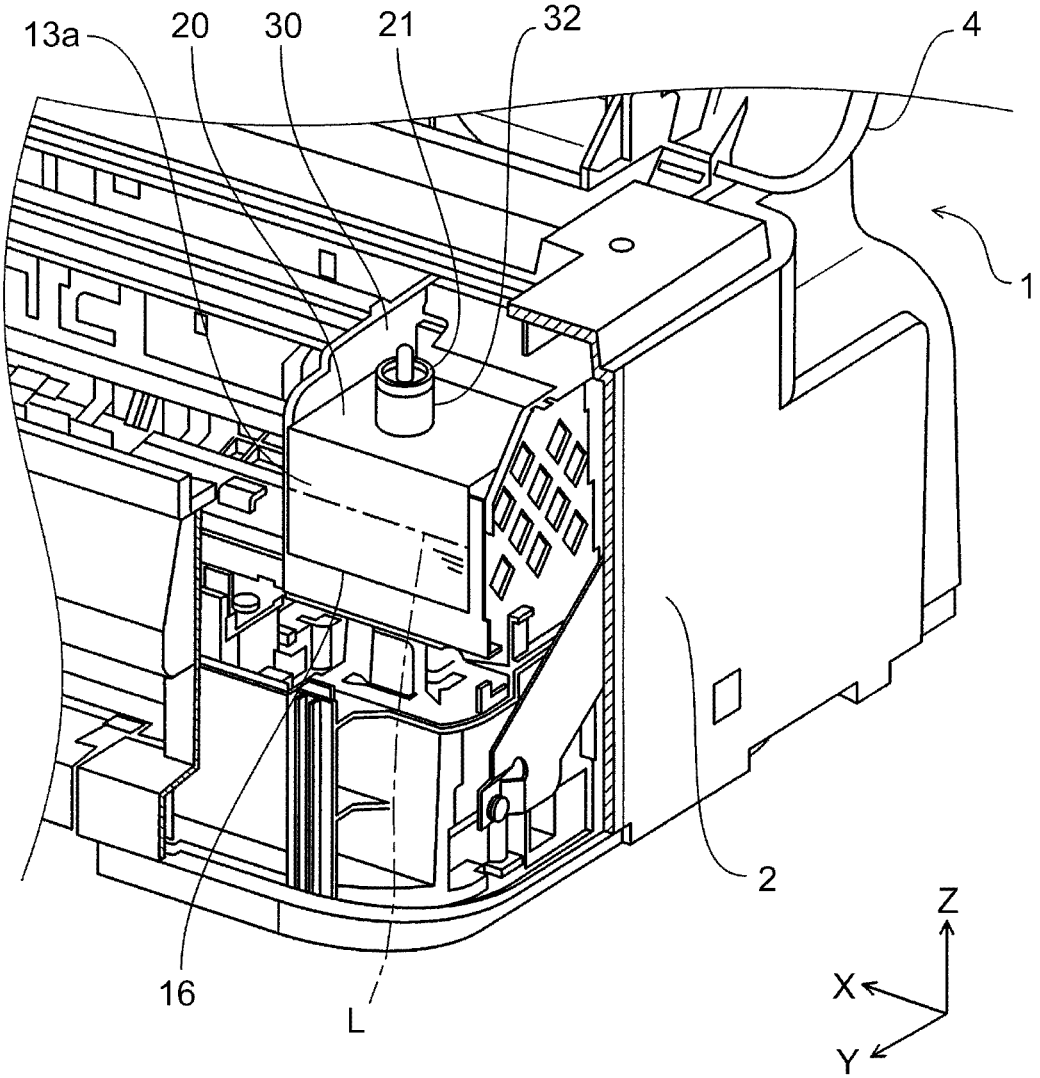
FIG. 5 is an enlarged perspective view illustrating a structure example of a liquid ejecting apparatus and the periphery thereof in which a portion of a housing is cut away.

The liquid filling port 32 is disposed above the liquid ejecting head 10 (refer to FIG. 5 and the like). The liquid filling port 32 of the present embodiment is disposed at a position at which the liquid filling port 32 does not overlap a nozzle forming surface 11R in a configuration when viewed in plan view from above (this refers to the configuration as viewed from above and is the same as the configuration represented by a plan view) (refer to FIG. 6). The nozzle forming surface 11R refers to a region in which the nozzles 11 are formed and is represented by a rectangle in FIG. 6 in the present embodiment, for example. In other words, the liquid filling port 32 of the present embodiment is disposed in a region other than the region which includes a track when the liquid filling port 32 is moved vertically directly above the nozzle forming surface 11R such that the liquid filling port 32 is not positioned directly above the nozzle forming surface 11R. Therefore, even in a case in which the ink dribbles from the liquid filling port 32 during the ink filling, comparatively, the ink does not easily reach the nozzle forming surface 11R and the adherence of the ink to the nozzle forming surface 11R which is under the liquid filling port 32 is suppressed.

The cap 60 is a member which inhibits clogging and the like of the nozzles 11 caused by drying of the liquid ejecting head 10. The cap 60 of the present embodiment is disposed at a position in contact with the liquid ejecting head 10 in a case in which the carriage 30 is at a predetermined position. In the present specification, an initial position of the carriage 30 which is a state in which the liquid ejecting head 10 and the cap 60 face each other is referred to as a home position HP (refer to FIG. 6). The cap 60 forms a closed space in which the nozzles 11 are open with respect to the liquid ejecting head 10 of the carriage 30 at the home position HP.

Figure 6:
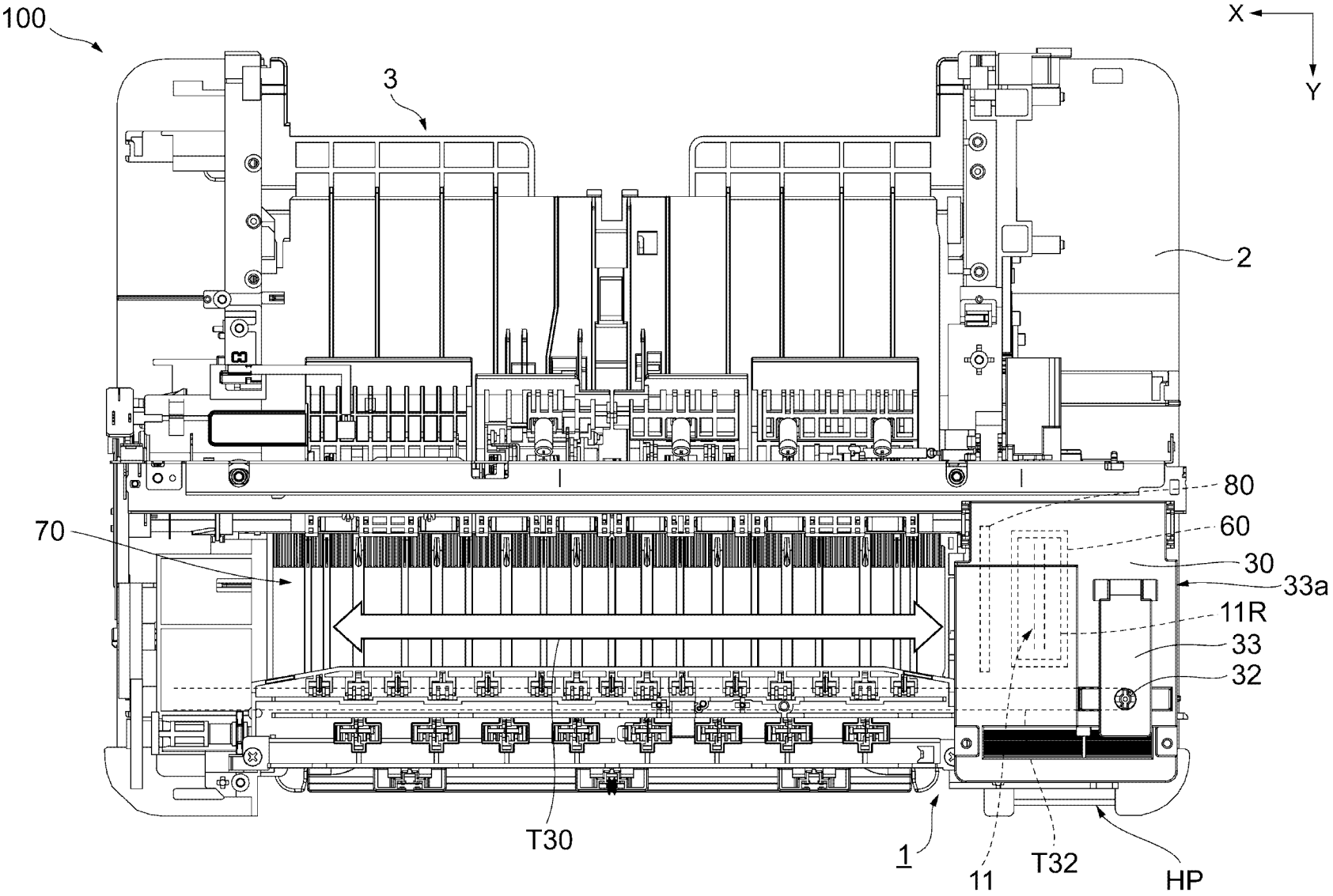
FIG. 6 is a plan view illustrates a configuration example of an inner portion of the printer.
Figure 7:
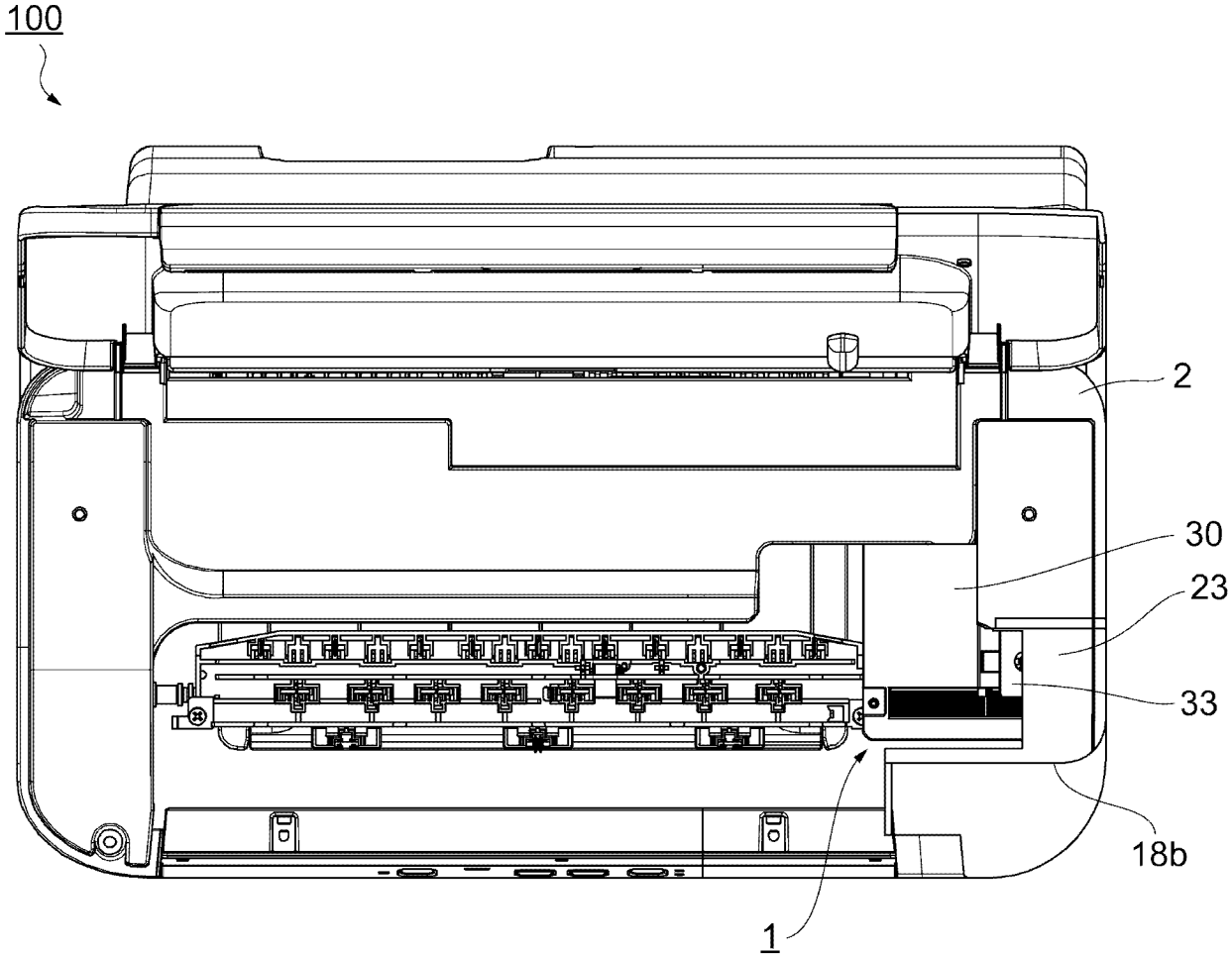
FIG. 7 is a plan view of the printer in a state in which a carriage is at a home position.
Figure 8:
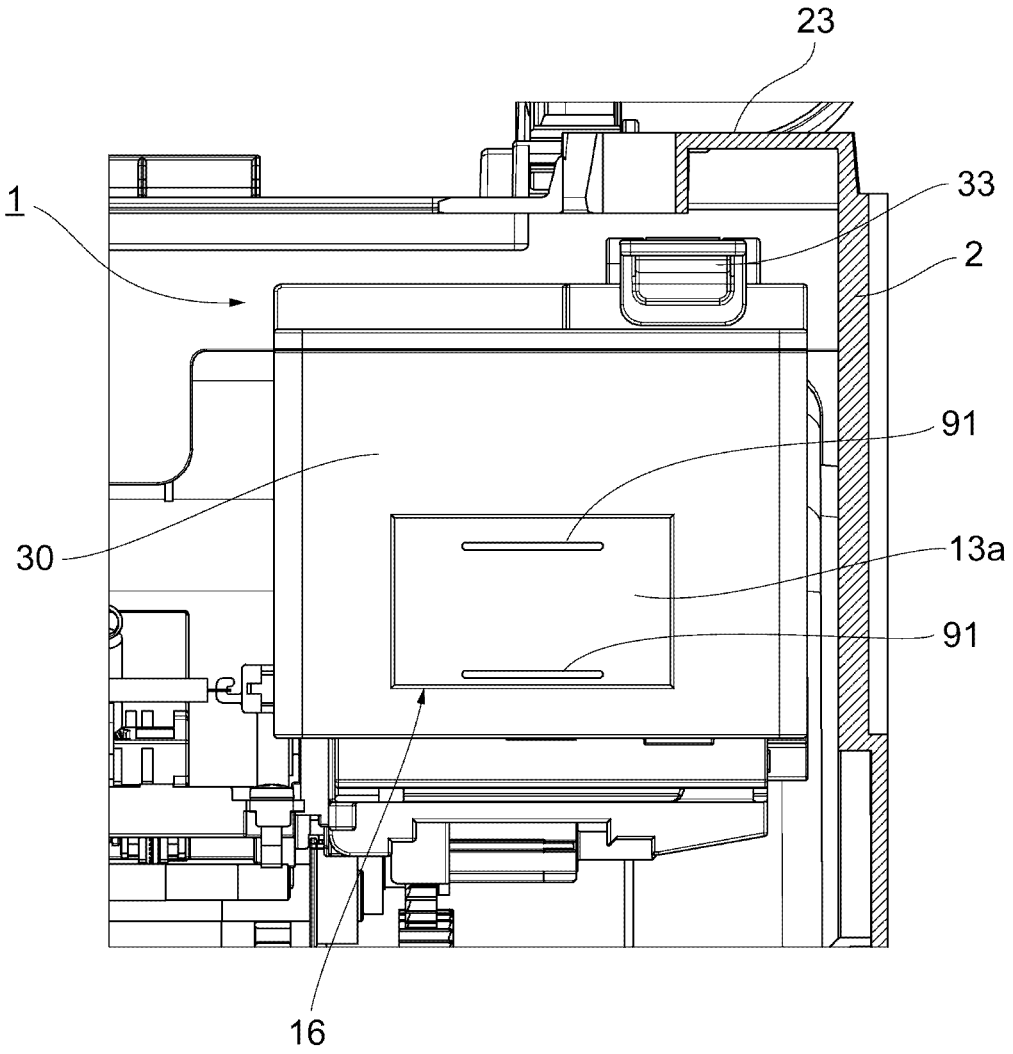
FIG. 8 is an enlarged front view illustrating the carriage from FIG. 7 and the periphery thereof.
Figure 9:
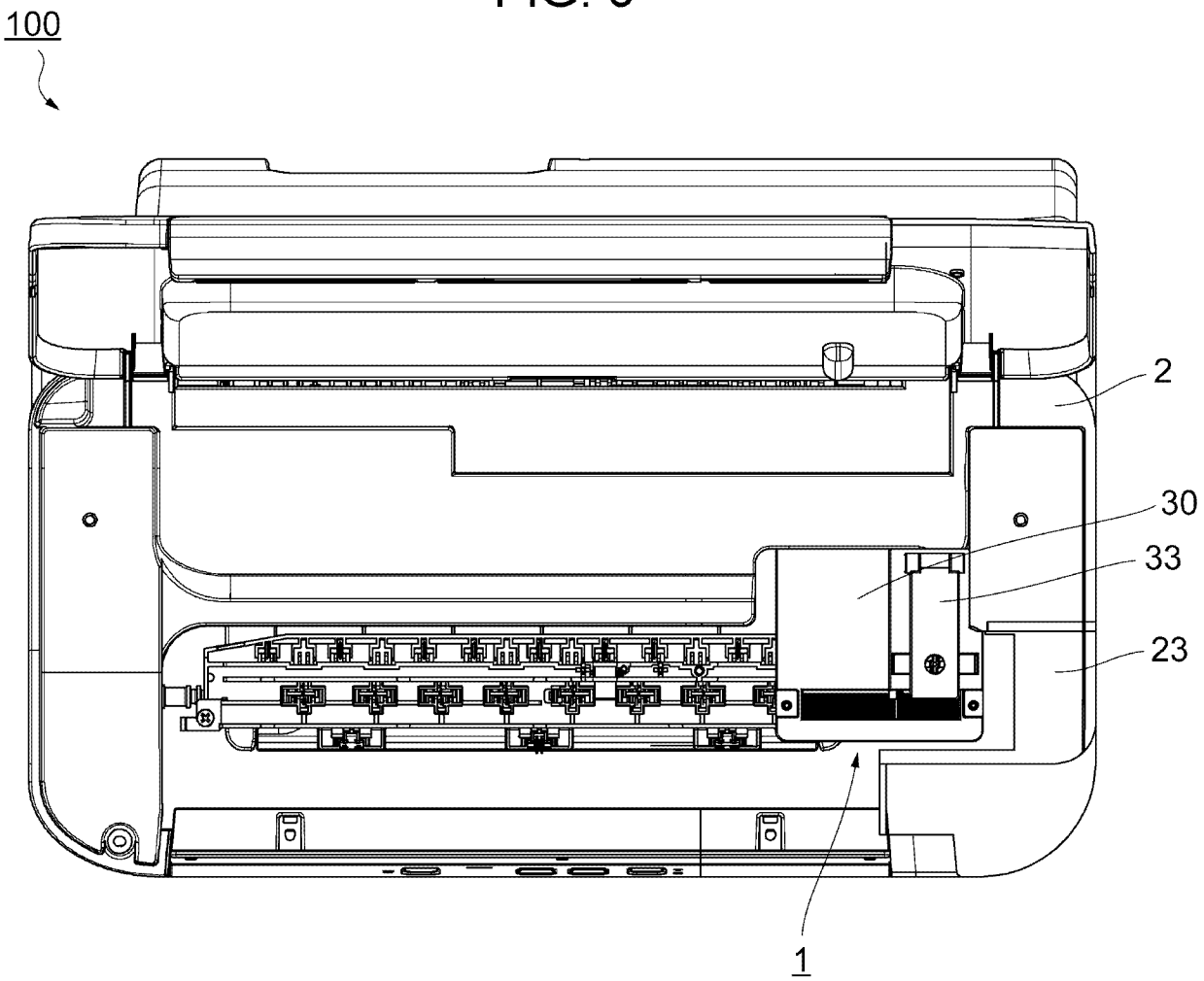
FIG. 9 is a plan view of the printer in a state in which the carriage is at a liquid-fillable position.
Figure 10:
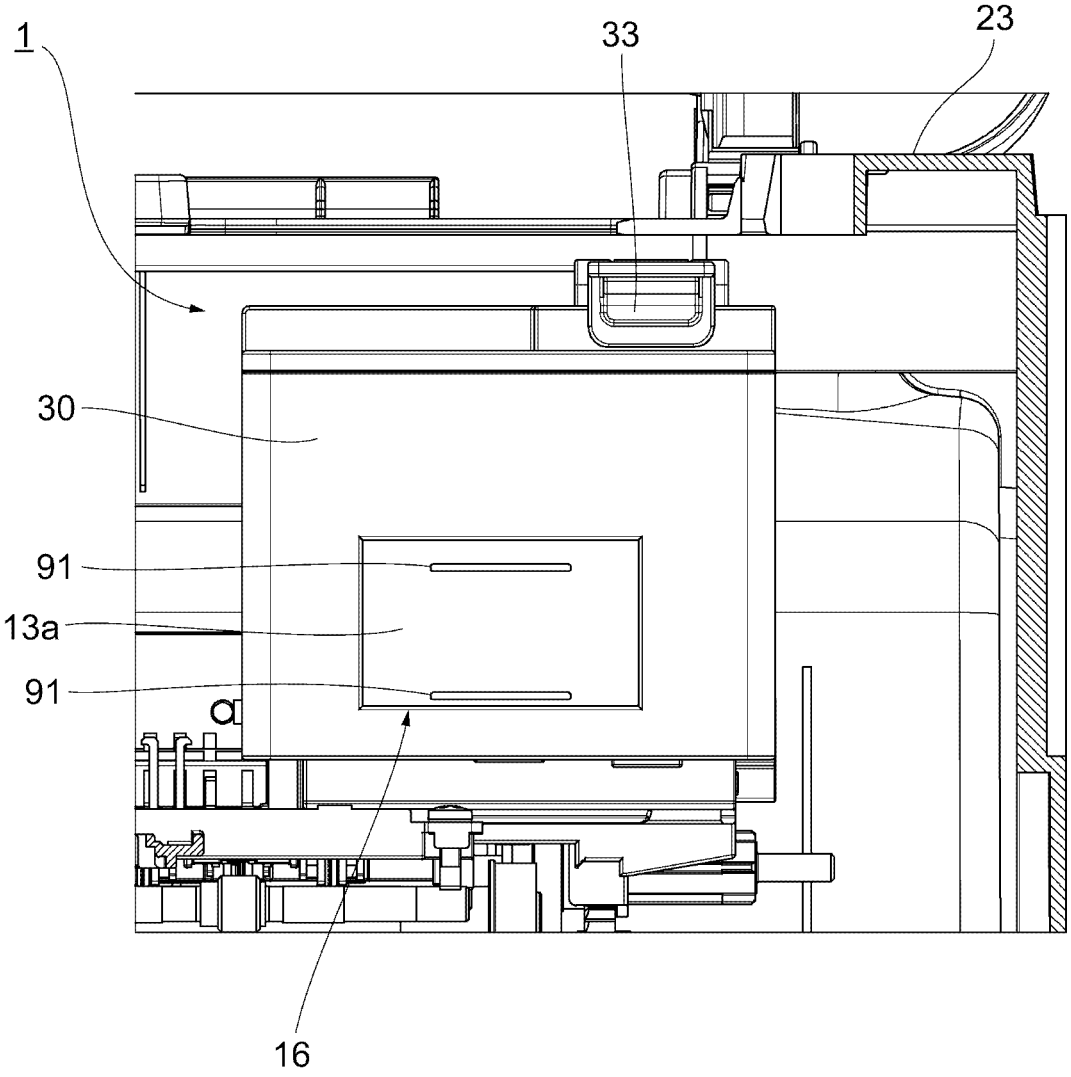
FIG. 10 is an enlarged front view illustrating the carriage from FIG. 9 and the periphery thereof.

As described above, whatever position the carriage 30 is at on the movement path T30 with respect to the cap 60, the liquid filling port 32 of the present embodiment is disposed at a position which does not overlap the cap 60 in plan view from above (refer to FIG. 6). Therefore, even if the ink dribbles from the liquid filling port 32 during the ink filling or the like, the ink does not easily reach the cap 60. Therefore, according to the liquid ejecting apparatus 1 of the present embodiment, it is possible to suppress dirtying of the liquid ejecting head 10 which originates in the dirtying of the cap 60.

The liquid filling port 32 is provided on one end side of the ink tank 20 in the movement direction (the X direction) of the carriage 30, for example, closer to the −X side than the center of the carriage 30 (refer to FIG. 6). In a case in which the user performs the ink refilling while supporting the refilling container 14 with one hand, as long as this configuration is adopted, the work of performing the ink refilling while checking the liquid surface L of the ink inside the ink tank 20 from the viewing portion (the first viewing portion 16 and the second viewing portion 17) is easy and it is possible to suppress situations in which the ink is mistakenly allowed to spill from the liquid filling port 32.

The wiping member 80 is disposed at a position at which the wiping member 80 is in contact with the liquid ejecting head 10 and is a member which wipes the liquid ejecting head 10 (refer to FIG. 6). It is favorable that, whatever position the carriage 30 is at on the movement path T30 with respect to the wiping member 80, the liquid filling port 32 be disposed at a position which does not overlap the wiping member 80 in plan view from above. For example, in the present embodiment, whatever position the carriage 30 is at on the movement path T30, the liquid filling port 32 is disposed at a position in front (the +Y direction) of the wiping member 80 (refer to FIG. 6). Therefore, even if the ink dribbles from the liquid filling port 32 during the ink filling, the ink does not easily reach the wiping member 80. Therefore, according to the liquid ejecting apparatus 1 of the present embodiment, it is possible to suppress dirtying of the liquid ejecting head 10 which originates in the dirtying of the wiping member 80.

The cap member 33 is a member which opens and closes the liquid filling port 32. The cap member 33 of the present embodiment is joined to a hinge portion 33*a* of the top surface of the carriage 30 by a pin and performs opening and closing operations centered on an axis which is parallel to the X direction. Since the cap member 33 opens the liquid filling port 32 by moving in a direction distancing from the viewing portion (the first viewing portion 16 and the second viewing portion 17), the cap member 33 does not impede the visual recognition of the liquid surface L of the ink inside the ink tank 20 during the ink filling. A portion of the cap member 33 may be configured as an elastic member, and the entirety of the cap member 33 may be configured as an elastic member.

In the liquid ejecting apparatus 1 of the present embodiment, the liquid-fillable position LFP and the home position HP of the carriage 30 are set at different positions which are deviated from each other. In general, when a pressing force acts downward on the cap 60 in a state in which the liquid ejecting head 10 and the cap 60 face each other, there is a concern of backflowing of the ink and bubbles into the nozzles 11 and cap breakage occurring under the influence of the pressing force. However, in the present embodiment, by deviating the liquid-fillable position LFP in this manner from the home position HP, even if the user pushes the refilling container 14 downward or the like and the pressing force acts on the cap 60 during the ink filling (refer to FIG. 4), the backflowing of the ink and bubbles into the nozzles 11 and cap breakage caused by the influence of the pressing force do not occur.

A portion of the housing 2 of the printer 100 is configured to function as the regulating portion 23 which regulates the opening and closing of the cap member 33 at a predetermined position (FIGS. 7 to 10). In the case of the present embodiment, when the carriage 30 is positioned at the home position HP (the position at which the liquid ejecting head 10 and the cap 60 face each other), the regulating portion 23 prevents an opening operation of the cap member 33 (refer to FIGS. 7 and 8) and when the carriage 30 is at the liquid-fillable position LFP, the regulating portion 23 does not prevent the opening operation of the cap member 33 (refer to FIGS. 9 and 10). According to the regulating portion 23, it is possible to suppress the occurrence of a situation in which the liquid filling port 32 is unintentionally opened at the home position HP or the like and the liquid spills out.

A holding portion 38 which holds the cap member 33 at a predetermined holding position in a state in which the liquid filling port 32 is opened is provided in the printer 100. Although not illustrated in detail, the holding portion 38 is configured by an edge portion of the housing 2 which is at a position at which a portion of the cap member 33 is locked, for example (refer to FIG. 9). Even in a case in which the ink dribbles along the cap member 33, the cap member 33 which is at the holding position is configured to be at a position distanced so as not to overlap the nozzle forming surface 11R in plan view from above such that the ink does not easily reach (the nozzle forming surface 11R of) the liquid ejecting head 10 (refer to FIG. 6).

As described hereunto, according to the liquid ejecting apparatus 1 of the present embodiment, even in a case in which the ink dribbles from the liquid filling port 32 during the liquid filling, since a configuration is adopted in which the ink does not easily reach the nozzle forming surface 11R, it is possible to suppress the occurrence of a reduction in reliability such as problems in the printing.

The above-described embodiment is intended to facilitate understanding of the invention and should not be interpreted as limiting the invention. Each element provided in the embodiment, its disposition, materials, conditions, shape, size, and the like are not limited to those exemplified and may be modified as appropriate. It is possible to partially replace or combine the configuration elements illustrated in different embodiments with each other.

Second Embodiment

Figure 11:
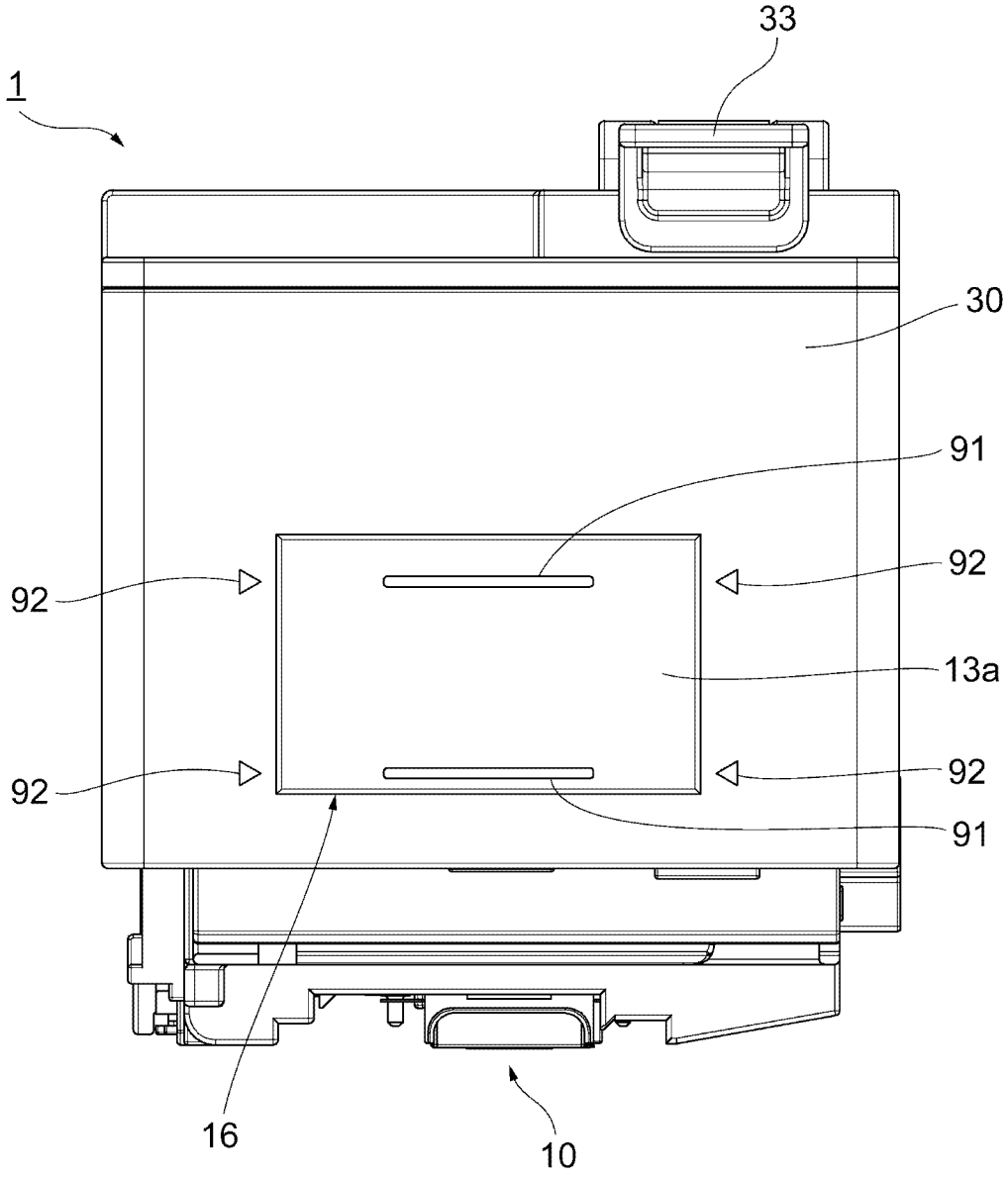
FIG. 11 is a diagram illustrating an example of the carriage of the liquid ejecting apparatus in which a scale is provided on a viewing portion.
Figure 12:
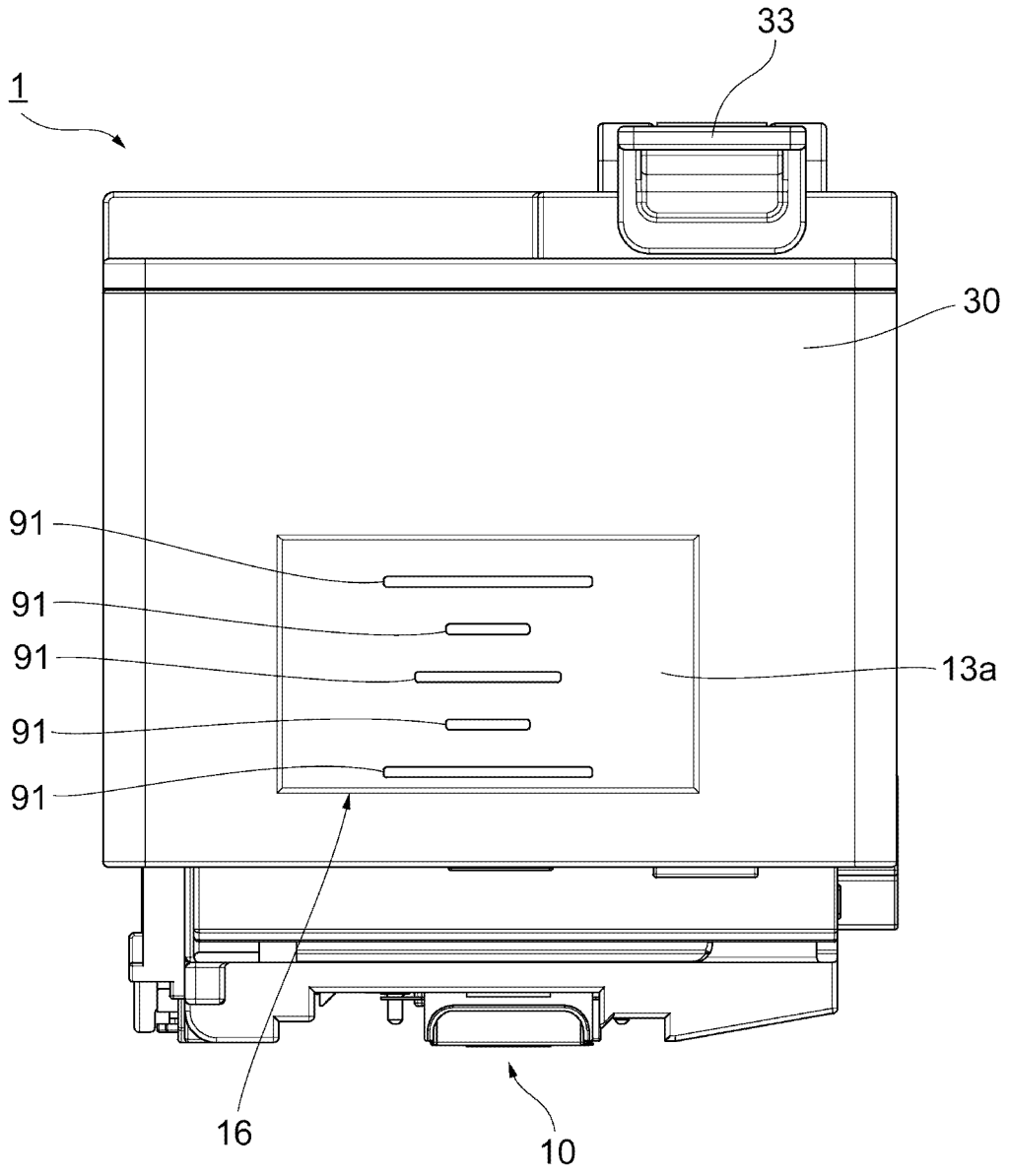
FIG. 12 is a diagram illustrating another example of the carriage of the liquid ejecting apparatus in which the scale is provided on the viewing portion.
Figure 13:
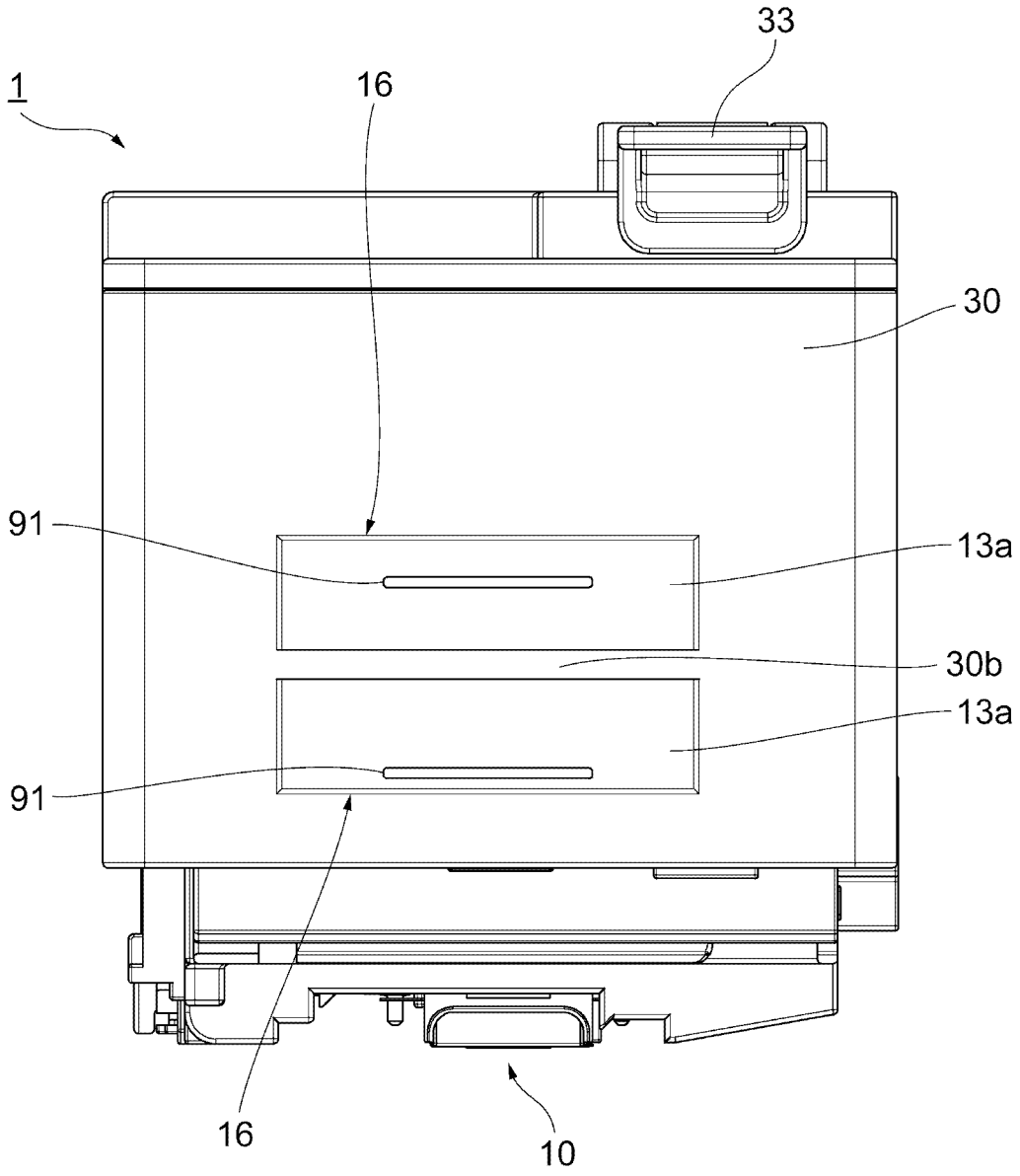
FIG. 13 is a diagram illustrating still another example of the carriage of the liquid ejecting apparatus in which the scale is provided on the viewing portion.

A scale which facilitates the discernment of the amount of the liquid surface L of the ink may be provided on the viewing portion (the first viewing portion 16 or the second viewing portion 17) or the level checking portion 13*a* of the ink tank 20 which are described in the first embodiment. Accordingly, it is possible to suppress the unintended spillage of the ink from the liquid filling port 32. For example, a case in which a line-shaped scale 91 indicating a high level and a low level of the liquid amount is provided on the level checking portion 13*a* (refer to FIGS. 8 and 10). Instead or additionally, it is possible to provide a scale 92 which is triangular, wedge-shaped, arrow-shaped, or the like corresponding to the height of each of the levels on the first viewing portion 16 (refer to FIG. 11). It is possible to more accurately ascertain the remaining amount by adding to the line-shaped scale 91 another scale 93 of a different length (refer to FIG. 12). It is possible to render the level checking portion 13*a* a bisected structure with a beam portion 30B which is formed in the first viewing portion 16 of the carriage 30 and to adopt a configuration in which approximately half of the liquid amount may be understood using the beam portion 30B which extends to cross the level checking portion 13*a* (refer to FIG. 13).

Third Embodiment

A configuration may be adopted in which it is possible to temporarily fix the cap member 33 to the holding position. In this case, it is possible to suppress the tendency of the cap member 33 to return to the original position and become a hindrance during the ink filling. It is also possible to suppress the occurrence of the ink mistakenly dribbling during the ink filling.

Fourth Embodiment

The carriage 30 may be configured such that it is possible to install ink tanks 20 (liquid storage members) corresponding to a plurality of colors. In this case, it is preferable that the liquid filling port 32 of each ink tank 20 not overlap the liquid ejecting head 10 in plan view from above. Furthermore, it is desirable that the liquid filling port 32 of each ink tank 20 not overlap the cap 60 and the wiping member 80 in plan view from above when the carriage 30 is on the movement path T30.

Fifth Embodiment

In the printer 100 which is provided with the carriage 30, the liquid ejecting head 10, the ink tank 20 (the liquid storage member), and the housing which stores the cap 60, the second viewing portion 17 may be provided such that the first viewing portion 16 of the carriage 30 is visible when the carriage 30 is at the home position HP (the position at which the liquid ejecting head 10 and the cap 60 face each other) or when the carriage 30 is at the liquid-fillable position LFP. In this case, since it is possible to view the liquid surface when necessary, it is easy to determine when to perform the refilling.

Sixth Embodiment

Figure 14:
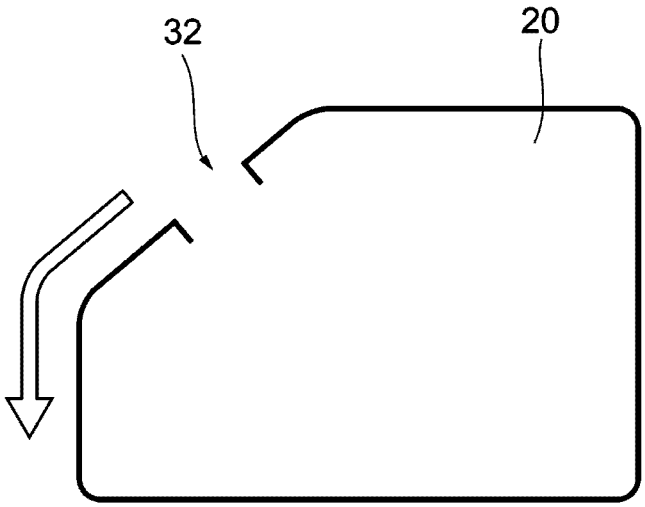
FIG. 14 is a diagram illustrating an example of the ink tank (a liquid storage member) in which a liquid filling port is disposed in an intersecting portion at which the top surface and the front surface intersect.

The liquid filling port 32 may be disposed at an intersecting portion at which the top surface and the front surface of the ink tank 20 (the liquid storage member) intersect (refer to FIG. 14). In this case, it is possible to view, via the viewing portion (the first viewing portion 16 and the second viewing portion 17), the ink which runs down the front surface in a case in which the ink dribbles from the liquid filling port 32. Accordingly, it is possible to recognize and handle ink dribbling from an early stage.

Seventh Embodiment

A receiving member which receives the liquid which falls from the moving carriage 30 may be provided above the medium transport apparatus (not illustrated) which transports the medium (for example, printing paper). In this case, a liquid discharge port for discharging the ink which dribbled inside the carriage 30 to the outside may be disposed at a position at which the liquid discharge port is vertically directly above the receiving member when the carriage 30 is above the movement path T30. In this case, when the ink dribbles from the liquid discharge port which is provided on the carriage 30, it is possible to suppress the falling of the ink directly onto the medium.

Eighth Embodiment

The liquid ejecting apparatus 1 in the printer 100 of the present embodiment is provided with the liquid ejecting head 10, the ink tank 20, the carriage 30, and the like. The carriage 30 is provided with a liquid discharge port 34, the cap member 33, and the like. The printer 100 may include an absorbing body 40, the cap 60, the wiping member 80, and the like.

Figure 15:
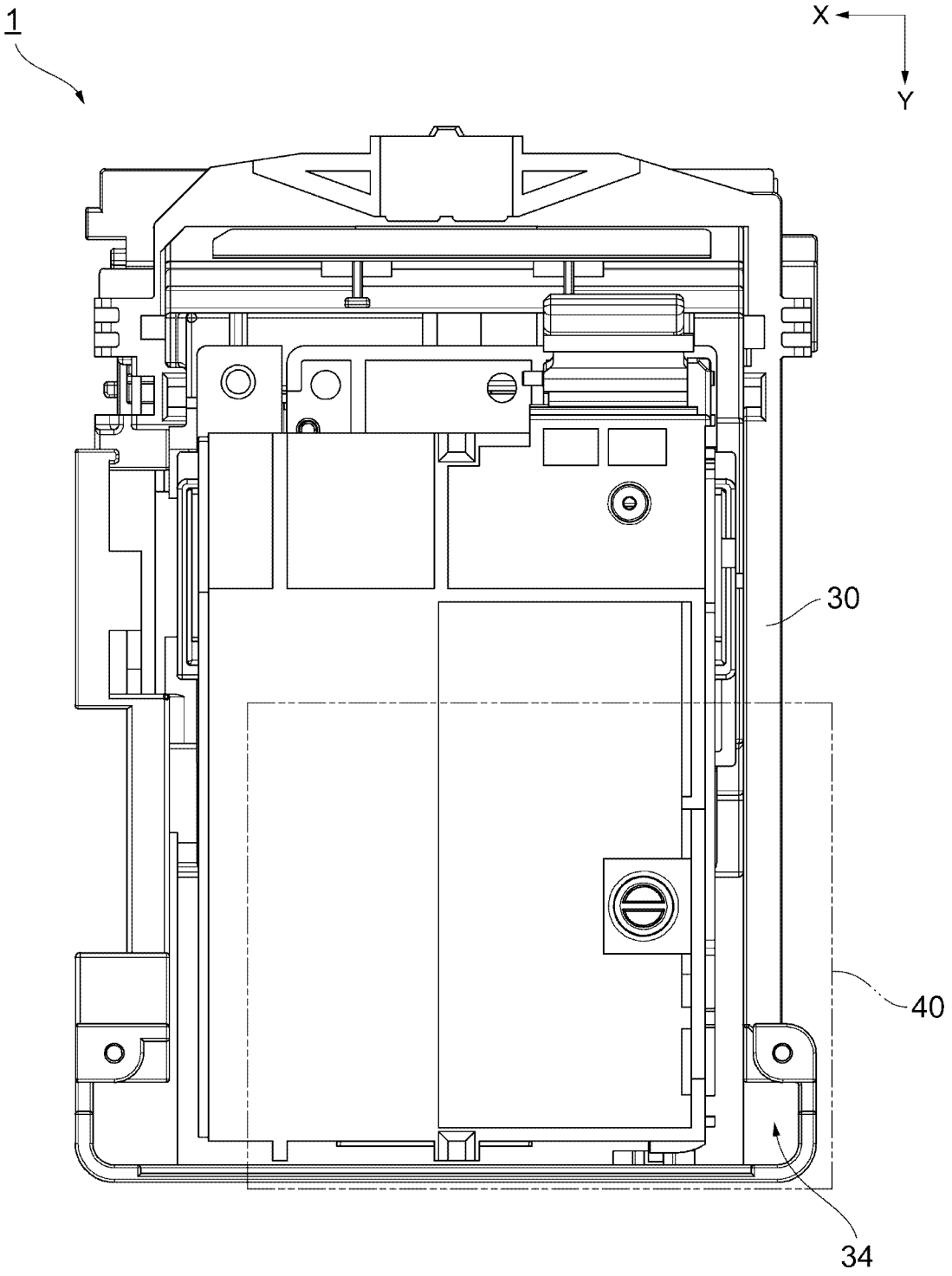
FIG. 15 is a plan view of the carriage.
Figure 16:
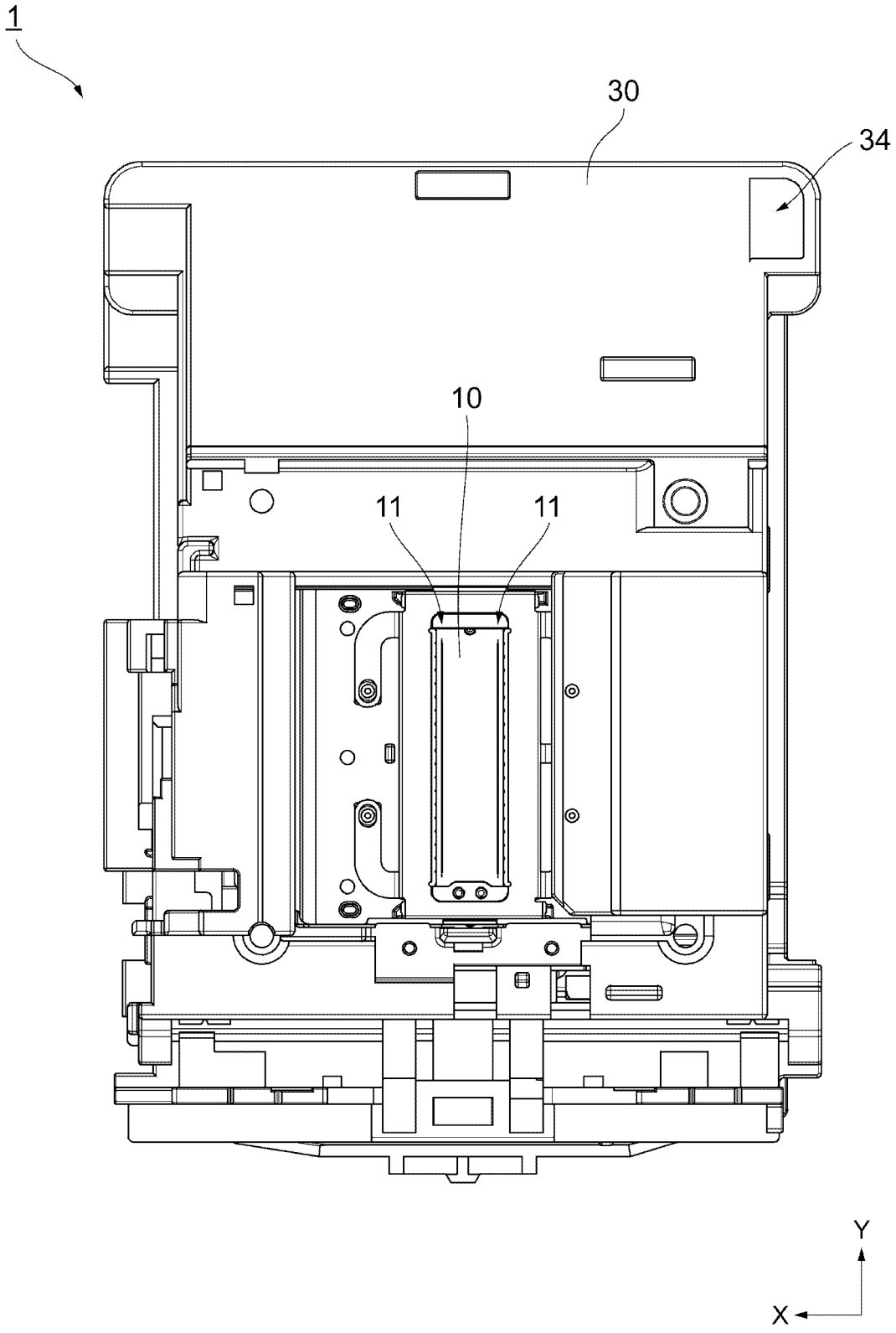
FIG. 16 is a diagram of a base surface of the carriage.
Figure 17:
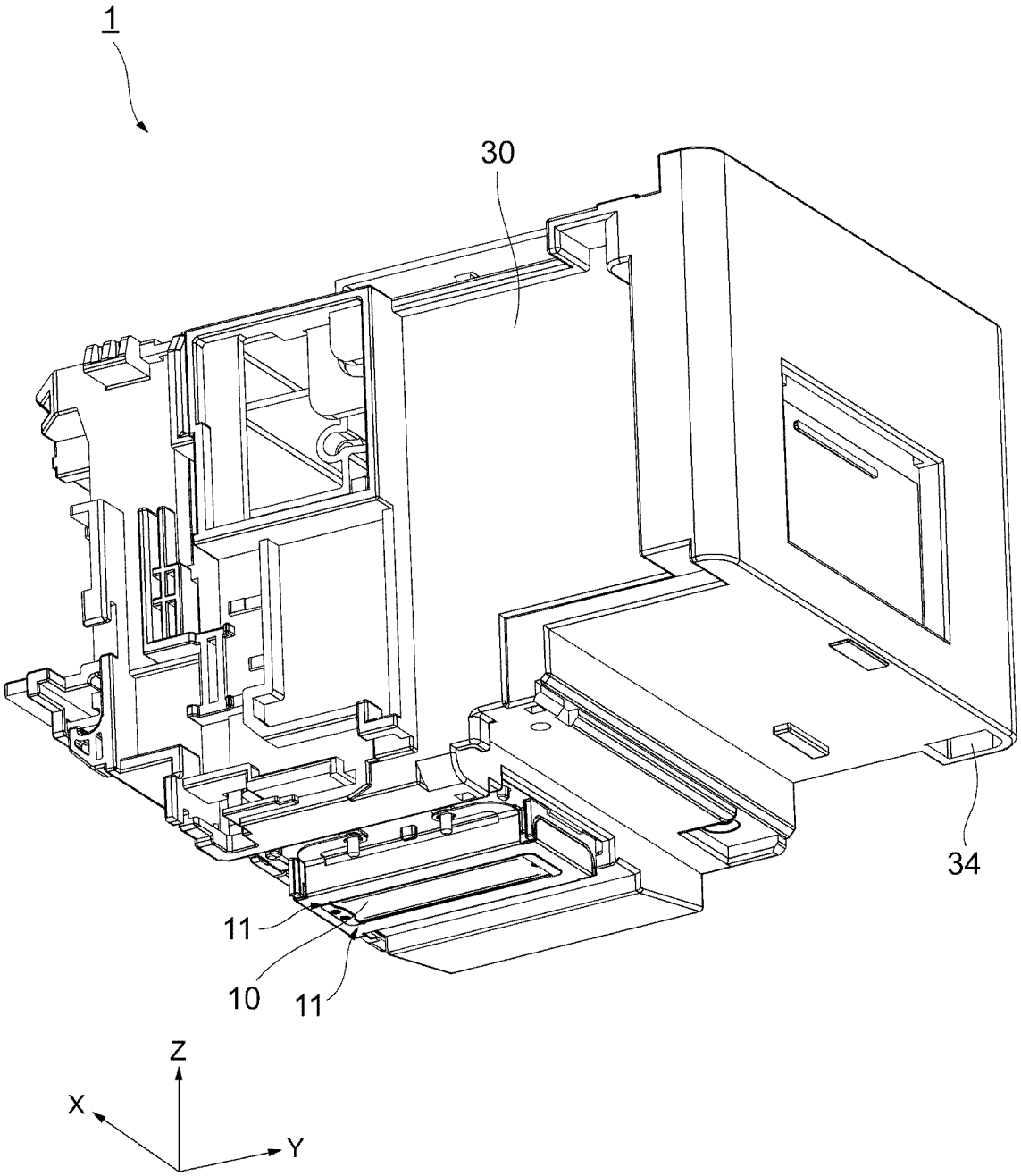
FIG. 17 is a perspective view of the carriage as viewed from below.

As illustrated in FIG. 15, the ink tank 20 which is provided with the liquid filling port 32 is embedded in the carriage 30 and a gap is provided between the wall surfaces of the −X direction side and the Y direction side of the ink tank 20 close to the liquid discharge port 34 and the carriage 30.

The liquid discharge port 34 is a discharge port which is provided in the base portion or the like of the carriage 30 such that the liquid such as the ink which flows into the carriage 30 is not discharged to the outside of the carriage 30. In a case in which the ink dribbles during the ink filling, the ink flows to the −X direction side or the Y direction side of the ink tank 20, travels along the wall surface of the ink tank 20, and dribbles down into the gap between the ink tank 20 and the carriage 30. Subsequently, the ink which travels along the base portion of the carriage 30 flows to the liquid discharge port 34 side and is discharged from the liquid discharge port 34 to the outside of the carriage 30 (refer to FIG. 18). Grooves and protrusions may be provided on the top surface of the ink tank 20 in which the liquid filling port 32 is provided and the wall surfaces of the −X direction side and the Y direction side of the ink tank 20 such that the ink that dribbles during the ink filling easily flows to the liquid discharge port 34 side.

It is preferable that the liquid filling port 32 and the liquid discharge port 34 be disposed on the same side in the movement direction of the carriage 30 when the carriage 30 moves along the movement path T30, using the liquid ejecting head 10 as a reference. In this case, it is possible for the ink which flows into the carriage 30 to reach the liquid discharge port 34 without crossing the liquid ejecting head 10 and the ink is easy to discharge. In the present embodiment, the liquid filling port 32 and the liquid discharge port 34 are both disposed in the −X direction (the direction of the right side as viewed from the front side of the printer 100), using the liquid ejecting head 10 as a reference (refer to FIG. 6 and the like).

It is preferable that the liquid discharge port 34 be disposed on the opposite side of the carriage 30 from the side on which the medium transport member, which transports the paper (the medium), is provided. For example, in the liquid ejecting apparatus 1 of the present embodiment in which the medium transport member is disposed in the vicinity of the center of the printer 100 in the width direction (the X direction), the liquid discharge port 34 is disposed at a position on the opposite side (the −X direction) from the side of the carriage 30 on which the medium transport member is provided (refer to FIG. 6 and the like). In a case in which the liquid discharge port 34 is disposed in this manner, it is possible to easily suppress the dirtying of the medium transport member or the transport path of the medium (the paper) by the ink that flows out from the liquid discharge port 34.

The absorbing body 40 is formed by a member which absorbs the ink. The absorbing body 40 of the present embodiment is provided at a position which is under the liquid discharge port 34 such that it is possible to absorb the ink which flows out from the liquid discharge port 34 when at least the carriage 30 is at the liquid-fillable position LFP (the position at which it is possible to fill the ink tank 20 with the liquid) (refer to FIG. 15). Since the ink which flows out from the liquid discharge port 34 is absorbed by the absorbing body 40, the ink is inhibited from adhering to other elemental members. For example, the ink is inhibited from traveling along the outside wall and the base surface of the housing 2 and leaking to the outside by absorbing the ink that flows out from the liquid discharge port 34 using the absorbing body 40.

Figure 18:
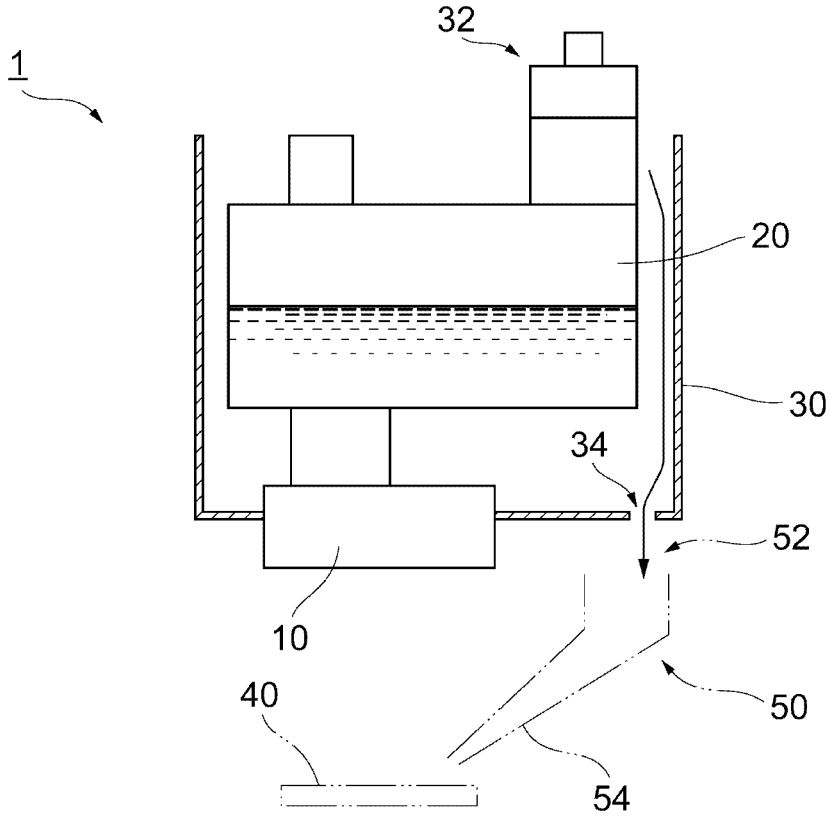
FIG. 18 is a diagram illustrating a schematic configuration of the carriage.

A liquid receiving member 50 is a member which guides the ink which flows out from the liquid discharge port 34 to the absorbing body 40. When at least the carriage 30 is at the liquid-fillable position LFP (the position at which it is possible to fill the ink tank 20 with the liquid), the liquid receiving member 50 is disposed at a position which is under the liquid discharge port 34 and over the absorbing body 40 (refer to FIG. 18). The liquid receiving member 50 illustrated in FIG. 18 is configured to include a receiving portion 52 which receives the ink that flows out from the liquid discharge port 34, and a guide portion 54 which guides the ink which is received by the receiving portion 52 toward the absorbing body 40. In a case in which the absorbing body 40 is not disposed directly under the liquid discharge port 34 or in a case in which such disposition is difficult or the like, it is possible to guide the ink that flows out from the liquid discharge port 34 to be absorbed by the absorbing body 40 by adopting the liquid receiving member 50 of such a configuration.

The cap 60 is a member which inhibits clogging and the like of the nozzles 11 caused by drying of the liquid ejecting head 10. The cap 60 of the present embodiment is disposed at a position in contact with the liquid ejecting head 10 in a case in which the carriage 30 is at a predetermined position. In the present specification, an initial position of the carriage 30 which is a state in which the liquid ejecting head 10 and the cap 60 face each other is referred to as a facing position or the home position HP (refer to FIG. 6). The cap 60 forms a closed space in which the nozzles 11 are open with respect to the liquid ejecting head 10 of the carriage 30 at the home position HP. The reference numeral 11R in FIG. 6 indicates the region in which the nozzles 11 are formed (the nozzle forming surface).

Here, in the liquid ejecting apparatus 1 of the present embodiment, the liquid-fillable position LFP and the home position HP of the carriage 30 are set at different positions which are deviated from each other. In general, when a pressing force acts downward on the cap 60 in a state in which the liquid ejecting head 10 and the cap 60 face each other, there is a concern of backflowing of the ink and bubbles and cap breakage occurring under the influence of the pressing force. However, in the present embodiment, by deviating the liquid-fillable position LFP in this manner from the home position HP, even if the user pushes the refilling container 14 downward or the like and the pressing force acts on the cap 60 during the ink filling (refer to FIG. 4), the backflowing of the ink and bubbles and cap breakage caused by the influence of the pressing force do not occur.

If the liquid discharge port 34 is provided at a position which does not overlap the cap 60 in plan view from above with respect to the cap 60 configured as described above when the carriage 30 is above the movement path T30, it is possible to inhibit the dirtying of the liquid ejecting head 10 originating in the dirtying of the cap by the discharged ink. For example, in the present embodiment, whatever position the carriage 30 is at on the movement path T30, the liquid discharge port 34 is disposed at a position closer to the front (the +Y direction) than the cap 60 (refer to FIG. 6).

The wiping member 80 is disposed at a position at which the wiping member 80 is in contact with the liquid ejecting head 10 and is a member which wipes the liquid ejecting head 10 (refer to FIG. 6). If the liquid discharge port 34 is provided at a position which does not overlap the wiping member 80 in plan view from above with respect to the liquid ejecting head 10 when the carriage 30 is above the movement path T30, the ink which flows out from the liquid discharge port 34 does not easily reach the wiping member 80 and it is possible to inhibit the dirtying of the wiping member 80. For example, in the present embodiment, whatever position the carriage 30 is at on the movement path T30, the liquid discharge port 34 is disposed at a position closer to the front (the +Y direction) than the wiping member 80 (refer to FIG. 6 and the like).

The cap member 33 is a member which opens and closes the liquid filling port 32. The cap member 33 of the present embodiment is joined to the hinge portion 33*a* of the top surface of the carriage 30 by a pin and performs opening and closing operations centered on an axis which is parallel to the X direction. Since the cap member 33 opens the liquid filling port 32 by moving in a direction distancing from the viewing portion (the first viewing portion 16 and the second viewing portion 17) during operation, the cap member 33 does not impede the visual recognition of the liquid surface L of the ink inside the ink tank 20 during the ink filling. A portion of the cap member 33 may be configured as an elastic member, and the entirety of the cap member 33 may be configured as an elastic member.

As described here, according to the liquid ejecting apparatus 1 of the present embodiment, even in a case in which the liquid dribbles from the liquid filling port during the liquid filling and flows into the carriage, it is possible to discharge the liquid that flows in from the liquid discharge port. Therefore, it is possible to inhibit the liquid from adhering to each element such as the liquid ejecting head and the maintenance system which are under the liquid filling port. It is possible to suppress the occurrence of problems in the head originating in ink dribbling. This is particularly applicable in a so-called on-carriage type liquid ejecting apparatus 1 in which it is considered common practice to adopt a configuration in which the liquid filling port 32 is disposed above the liquid ejecting head 10 and the maintenance system such as the cap 60 and the wiping member 80.

The above-described embodiment is intended to facilitate understanding of the invention and should not be interpreted as limiting the invention. Each element provided in the embodiment, its disposition, materials, conditions, shape, size, and the like are not limited to those exemplified and may be modified as appropriate. It is possible to partially replace or combine the configuration elements illustrated in different embodiments with each other.

Ninth Embodiment

In the above-described embodiments, an example is given in which the liquid discharge port 34 is provided on the base surface of the carriage 30. However, the liquid discharge port 34 may be provided on the side surface of the carriage 30 instead of or in addition to the base surface.

Tenth Embodiment

In a case in which the liquid discharge port 34 is provided on the side surface of the carriage 30, a portion or all of the liquid discharge port 34 may be inclined downward from the inner portion of the carriage 30 toward the outside. In this case, the ink which dribbles in the inner portion of the carriage 30 is easily allowed to flow out to the outside.

Eleventh Embodiment

Figure 19:
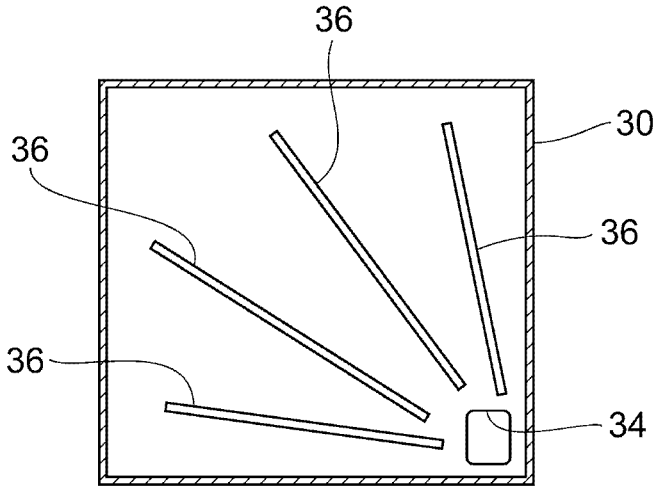
FIG. 19 is a plan view illustrating a configuration example of the carriage in which grooves are provided in the inner portion.

Grooves 36 which extend toward the liquid discharge port 34 may be provided in the inner portion of the carriage 30 (refer to FIG. 19). In this case, it is easy to guide the ink that dribbles into the inner portion of the carriage 30 to the liquid discharge port 34 using a capillary force of the grooves 36.

Twelfth Embodiment

A waste liquid storage portion (not illustrated) which stores the ink that is discharged from the liquid ejecting head 10 may be provided in the liquid ejecting apparatus 1. The absorbing body 40 which is provided at a position which is vertically directly under the liquid discharge port 34 may be an absorbing body which is provided in the waste liquid storage portion. In this case, it is not necessary to configure the absorbing body using a separate member which leads to a reduction in cost.

Thirteenth Embodiment

The carriage 30 may be configured such that it is possible to install ink tanks 20 (liquid storage members) corresponding to a plurality of colors.

Fourteenth Embodiment

A receiving member which receives the liquid which falls from the moving carriage 30 may be provided above the medium transport apparatus (not illustrated) which transports the medium (for example, printing paper). In this case, the liquid discharge port 34 may be disposed to move vertically directly above the receiving member when the carriage 30 is above the movement path T30. In this case, when the ink dribbles from the liquid discharge port 34, it is possible to suppress the falling of the ink directly onto the medium or the transport path of the medium.

INDUSTRIAL APPLICABILITY

It is favorable to apply the invention to a liquid ejecting apparatus of a recording apparatus which includes a recording unit which performs recording on a medium.

The liquid which is ejected by the liquid ejecting head 10 is not limited to an ink and may be, for example, a liquid-state body or the like in which particles of a functional material are dispersed or mixed into a liquid. For example, a configuration may be adopted in which the liquid ejecting head 10 ejects a liquid-state body which contains a material such as an electrode material or a color material (pixel material) in the form of a dispersion or a solution. The electrode material or the color material may be used in the manufacture or the like of liquid crystal displays, Electro-Luminescence (EL) displays, and surface emission displays.

Hereinafter, a description will be given of the technical ideas to be ascertained from the embodiments and the operations and effects thereof.

Idea 1

A liquid ejecting apparatus includes a liquid ejecting head which ejects a liquid from a nozzle onto a medium, a liquid storage member which stores the liquid to be supplied to the liquid ejecting head, and a carriage on which the liquid ejecting head and the liquid storage member are installed and which is capable of moving on a movement path, in which the liquid storage member includes a liquid filling port which is disposed above the liquid ejecting head and is for filling the liquid, and in which the liquid filling port is provided at a position which does not overlap with a nozzle forming surface in which the nozzle is formed in plan view from above.

In this configuration, since the liquid does not easily reach the nozzle forming surface even in a case in which the liquid dribbles from the liquid filling port during the filling of the liquid, it is possible to suppress a reduction in the reliability such as problems in the printing.

Idea 2

The liquid ejecting apparatus according to Idea 1 further includes a cap capable of forming a closed space in which the nozzle opens at a position facing the nozzle forming surface, in which when the carriage is above the movement path, the liquid filling port is provided at a position which does not overlap the cap in plan view from above.

In this configuration, since the liquid does not easily reach the cap even in a case in which the liquid dribbles from the liquid filling port during the filling of the liquid, it is possible to suppress the dirtying of the liquid ejecting head originating in the dirtying of the cap.

Idea 3

The liquid ejecting apparatus according to Idea 1 or Idea 2 further includes a wiping member capable of wiping the nozzle forming surface, in which when the carriage is above the movement path, the liquid filling port is provided at a position which does not overlap with the wiping member in plan view from above.

In this configuration, since the liquid does not easily reach the wiping member even in a case in which the liquid dribbles from the liquid filling port during the filling of the liquid, it is possible to suppress the dirtying of the liquid ejecting head originating in the dirtying of the wiping member.

Idea 4

The liquid ejecting apparatus according to any one of Idea 1 to Idea 3, in which the carriage includes a viewing portion which renders the liquid storage member visually recognizable, and in which the liquid filling port is provided on one end side of the liquid storage member in a movement direction of the carriage.

In this configuration, since it is possible to fill the liquid storage member with the liquid while viewing the liquid surface inside the liquid storage member via the viewing portion, it is possible to suppress the incidence of mistakenly allowing the liquid to spill from the liquid filling port.

Idea 5

The liquid ejecting apparatus according to any one of Idea 1 to Idea 4 further includes a cap member which opens and closes the liquid filling port, in which the carriage includes a viewing portion which renders the liquid storage member visually recognizable, and in which the cap member opens the liquid filling port by moving in a direction distancing from the viewing portion.

In this configuration, since it is possible to fill the liquid storage member with the liquid while viewing the liquid surface inside the liquid storage member via the viewing portion without the cap member hiding the viewing portion, it is possible to suppress the incidence of mistakenly allowing the liquid to spill from the liquid filling port.

Idea 6

The liquid ejecting apparatus according to any one of Idea 1 to Idea 5 further includes a cap member which opens and closes the liquid filling port and a regulating portion which regulates opening and closing operations of the cap member when the liquid ejecting head and the cap are at positions facing each other.

In this configuration, it is possible to suppress the liquid spilling originating in the liquid filling port being unintentionally opened.

Idea 7

The liquid ejecting apparatus according to any one of Idea 1 to Idea 6 further includes a cap member which opens and closes the liquid filling port and a holding portion which holds the cap member at a predetermined holding position in a state in which the liquid filling port is open, in which the cap member which is at the holding position does not overlap with the nozzle forming surface in plan view from above.

In this configuration, since the liquid does not easily reach the nozzle forming surface even in a case in which the liquid dribbles from the cap member, it is possible to suppress a reduction in the reliability such as problems in the printing.

Idea 8

A liquid ejecting apparatus includes a liquid ejecting head which ejects a liquid from a nozzle onto a medium, a liquid storage member which stores the liquid to be supplied to the liquid ejecting head, and a carriage on which the liquid ejecting head and the liquid storage member are installed and which is capable of moving on a movement path, in which the liquid storage member includes a liquid filling port which is disposed above the liquid ejecting head and is for filling the liquid, and in which the carriage includes a liquid discharge port capable of discharging the liquid that flows into the carriage.

In this configuration, even in a case in which the liquid dribbles from the liquid filling port during the liquid filling and flows into the carriage, it is possible to discharge the liquid that flows in from the liquid discharge port. Therefore, it is possible to inhibit the liquid from adhering to each element such as the liquid ejecting head and the maintenance system which are under the liquid filling port.

Idea 9

The liquid ejecting apparatus according to Idea 8, in which the liquid filling port and the liquid discharge port are disposed on the same side in the movement direction of the carriage using the liquid ejecting head as a reference.

In this configuration, since the liquid that flows into the carriage reaches the liquid discharge port even without exceeding the liquid ejecting head, the liquid is easier to discharge.

Idea 10

The liquid ejecting apparatus according to Idea 8 or Idea 9, in which an absorbing body is provided at a position which is under the liquid discharge port when the carriage is at a position at which it is possible to fill the liquid storage member with the liquid.

In this configuration, since it is possible to absorb the liquid that flows out from the liquid discharge port using the absorbing body, it is easier to inhibit the adherence of the liquid onto the other elements.

Idea 11

The liquid ejecting apparatus according to Idea 10, in which a liquid receiving member capable of receiving the liquid which flows out from the liquid discharge port is provided at a position which is under the liquid discharge port and over the absorbing body when the carriage is at a position at which it is possible to fill the liquid storage member with the liquid, and in which the liquid receiving member includes a receiving portion capable of receiving the liquid and a guide portion which guides the liquid which is received by the receiving portion to the absorbing body side.

In this configuration, even in a case of a configuration in which the absorbing body is not disposed directly under the discharge port or such a disposition is difficult, it is possible to guide the liquid that flows out from the liquid discharge port and cause the liquid to be absorbed by the absorbing body.

Idea 12

The liquid ejecting apparatus according to any one of Idea 8 to Idea 11 further includes a cap which is in contact with the liquid ejecting head at a predetermined position and is capable of forming a closed space in which the nozzle opens, in which a liquid-fillable position of the carriage which is a position at which it is possible to fill the liquid storage member with the liquid is set to be a different position from a facing position which is a position at which the liquid ejecting head and the cap face each other.

In this configuration, in the liquid ejecting apparatus including the cap for inhibiting the clogging or the like of the nozzle caused by drying, by performing the liquid filling work in a state in which the liquid ejecting head is deviated from the cap, it is possible to inhibit liquid backflowing, bubbles backflowing, and cap breakage which may occur when unintentionally pressing the cap in a non-deviated state.

Idea 13

The liquid ejecting apparatus according to Idea 12 further includes a medium transport member which transports the medium, in which, when the carriage is at the liquid-fillable position, the liquid discharge port is positioned at the opposite side from a side of the carriage on which the medium transport member is provided.

In this configuration, it is possible to suppress the dirtying of the medium transport member and the transport path of the medium with the liquid that flows out from the liquid discharge port.

Idea 14

The liquid ejecting apparatus according to Idea 12 or Idea 13, in which when the carriage is above the movement path, the liquid discharge port is provided at a position which does not overlap with the cap in plan view from above.

In this configuration, since the liquid discharge port does not pass over the cap, it is possible to inhibit the dirtying of the liquid ejecting head originating in the dirtying of the cap with the discharged liquid.

Idea 15

The liquid ejecting apparatus according to any one of Idea 8 to Idea 14 further includes a wiping member capable of wiping the liquid ejecting head, in which when the carriage is above the movement path, the liquid discharge port is provided at a position which does not overlap with the wiping member in plan view from above.

In this configuration, since the ink does not easily reach the wiping member when the liquid flows out from the liquid discharge port, it is possible to inhibit the dirtying of the liquid ejecting head originating in the dirtying of the wiping member.

The entire disclosure of Japanese Patent Application No. 2017-195823, filed Oct. 6, 2017 and Japanese Patent Application No. 2017-196624, filed Oct. 10, 2017 and Japanese Patent Application No. 2018-052174, filed Mar. 20, 2018 are expressly incorporated by reference herein.

What is claimed is:

1. A liquid ejecting apparatus comprising:

a liquid ejecting head which ejects a liquid from a nozzle onto a medium;

a liquid storage member which stores the liquid to be supplied to the liquid ejecting head; and a carriage on which the liquid ejecting head and the liquid storage member are installed and which is capable of moving on a movement path, wherein the liquid storage member includes a liquid filling port which is disposed above the liquid ejecting head and is for filling the liquid, wherein the liquid filling port is provided at a position which does not overlap with a nozzle forming surface in which the nozzle is formed in plan view from above, and wherein the liquid filling port is configured to allow a refilling container to be mounted onto the liquid filling port in a state where the liquid storage member is installed on the carriage.

2. The liquid ejecting apparatus according to claim 1, further comprising:

a cap capable of forming a closed space in which the nozzle opens at a position facing the nozzle forming surface, wherein when the carriage is above the movement path, the liquid filling port is provided at a position which does not overlap with the cap in plan view from above.

3. The liquid ejecting apparatus according to claim 1, further comprising:

a wiping member capable of wiping the nozzle forming surface, wherein when the carriage is above the movement path, the liquid filling port is provided at a position which does not overlap with the wiping member in plan view from above.

4. The liquid ejecting apparatus according to claim 1, wherein the carriage includes a viewing portion which renders the liquid storage member visually recognizable, and wherein the liquid filling port is provided on one end side of the liquid storage member in a movement direction of the carriage.

5. The liquid ejecting apparatus according to claim 1, further comprising:

a cap member which opens and closes the liquid filling port, wherein the carriage includes a viewing portion which renders the liquid storage member visually recognizable, and wherein the cap member opens the liquid filling port by moving in a direction distancing from the viewing portion.

6. The liquid ejecting apparatus according to claim 1, further comprising:

a cap member which opens and closes the liquid filling port; and a regulating portion which regulates opening and closing operations of the cap member when the liquid ejecting head and the cap are at positions facing each other.

7. The liquid ejecting apparatus according to claim 1, further comprising:

a cap member which opens and closes the liquid filling port; and a holding portion which holds the cap member at a predetermined holding position in a state in which the liquid filling port is open, wherein the cap member which is at the holding position does not overlap with the nozzle forming surface in plan view from above.

8. The liquid ejecting apparatus according to claim 1, wherein the liquid filling port is configured to allow the refilling container to be mounted onto the liquid filling port when the carriage is positioned at a predetermined liquid-fillable position.

9. The liquid ejecting apparatus according to claim 8, further comprising:

a cap configured to cover the nozzle when the carriage at a home position, wherein the liquid-fillable position is different from the home position.

10. The liquid ejecting apparatus according to claim 1, further comprising:

a cap member configured to rotate centered on an axis extending in a moving direction in which the carriage moves, the cap member rotating between a covering position which covers the liquid filling port and an exposing position which exposes the liquid filling port.

11. The liquid ejecting apparatus according to claim 10, wherein the carriage includes a viewing portion which renders a level checking portion of the liquid storage member visually recognizable, wherein the level checking portion includes a material which has transparency, and wherein the cap member exposes the liquid filling port by rotating in a direction distancing from the level checking portion.

12. The liquid ejecting apparatus according to claim 10, further comprising:

a cap configured to cover the nozzle when the carriage at a home position, and a regulating portion, which regulates rotating of the cap member from the covering position to the exposing position when the carriage is at the home position.

13. The liquid ejecting apparatus according to claim 11, wherein at least one of the level checking portion and the viewing portion includes a scale.

* * * * *